US007731179B2

(12) United States Patent
Izuchi et al.

(10) Patent No.: US 7,731,179 B2
(45) Date of Patent: Jun. 8, 2010

(54) SHEET TRAY ASSEMBLY

(75) Inventors: Masatoshi Izuchi, Ichinomiya (JP); Keisuke Wakakusa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/236,475

(22) Filed: Sep. 23, 2008

(65) Prior Publication Data

US 2009/0085278 A1 Apr. 2, 2009

(30) Foreign Application Priority Data

Sep. 28, 2007 (JP) ..... 2007-252939

(51) Int. Cl.
*B65H 1/00* (2006.01)

(52) U.S. Cl. ..... 271/145; 271/162; 271/164

(58) Field of Classification Search ..... 271/145, 271/162, 163, 164; 220/810; 211/226.2, 211/126.6

See application file for complete search history.

(56) References Cited

U.S. PATENT DOCUMENTS

| | | | | |
|---|---|---|---|---|
| 4,456,240 | A * | 6/1984 | Chu et al. | 271/4.1 |
| 4,940,222 | A | 7/1990 | Maeno et al. | |
| 7,481,425 | B2 * | 1/2009 | Chikumoto | 271/164 |
| 7,549,632 | B2 * | 6/2009 | Kojima et al. | 271/160 |
| 2005/0225025 | A1 | 10/2005 | Chikumoto | |
| 2007/0138193 | A1 | 6/2007 | Aono et al. | |
| 2007/0222143 | A1 | 9/2007 | Murayama et al. | |

FOREIGN PATENT DOCUMENTS

JP 2007-160816 A 6/2007

OTHER PUBLICATIONS

European Patent Office; European Search Report, documents considered to be relevant and cited in EP Application No. 08016627 (counterpart to the above-captioned U.S. patent application) mailed Jan. 22, 2009.

* cited by examiner

*Primary Examiner*—Kaitlin S Joerger
(74) *Attorney, Agent, or Firm*—Baker Botts, LLP.

(57) ABSTRACT

A sheet tray assembly including: (a) a tray unit configured to accommodate sheets, and having an upper opening for allowing the sheets to be introduced into the tray unit via the upper opening; (b) a cover unit configured to cover the upper opening; and (c) a link interconnecting the tray unit and the cover unit, and having (c-1) a first end portion at which the link is connected to the tray unit and (c-2) a second end portion at which the link is connected to a proximal end portion of the cover unit. The link is movable between first and second pivot positions as a result of pivot movement of the link relative to the tray unit, whereby a posture of the link is changeable by the pivot movement, such that the second end portion of the link is placed in a first height level when the link is positioned in the first pivot position, and is placed in a second height level that is higher than the first height level when the link is positioned in the second pivot position.

17 Claims, 15 Drawing Sheets

SHEET TRAY ASSEMBLY

CROSS REFERENCE TO RELATED APPLICATION

This application claims priority from Japanese Patent Application No. 2007-252939 filed on Sep. 28, 2007, the disclosure of which is herein incorporated by reference in its entirety.

BACKGROUND OF THE INVENTION

1. Field of the Invention

The present invention relates to a sheet tray assembly that is to be detachably disposed in an image recording apparatus.

2. Discussion of Related Art

In an inkjet printer, recording sheets are conveyed along a sheet path by a sheet conveyor, and each of the recording sheets is subjected to a recording operation performed by an image recorder. The recording sheet is performed by a recording head of the image recorder which is activated to eject ink onto each recording sheet while the recording sheet is being conveyed. US 2007/0138193A1 (corresponding to JP-2007-160816A) discloses an inkjet printer in which a printer cover can be opened to permit a maintenance operation to be performed onto a sheet conveyor and an image recorder that are provided inside the printer. The printer cover is connected via a link to a housing of a main body of the printer. The link has holes provided in its respective opposite end portions. A first shaft provided in the housing is introduced in one of the holes of the link, while a second shaft provided in the printer cover is introduced in the other of the holes of the link. A coil spring is attached to the first shaft, and constantly forces or biases the link to be pivoted in a direction that causes the pivot cover to be opened. The printer cover is pivotable relative to the housing about the first and second shafts, i.e., two axes. When the printer cover is raised by a user, the printer cover and the link are pivoted integrally with each other relative to the main body of the printer. When the link has been pivoted to a predetermined position, the link is brought into contact at its protruding portion with the housing. In this state, the pivot movement of the link is stopped by the contact of the link with the housing. From this state, the printer cover is pivoted relative to the link as well as the main body of the printer. An opening of the main body of the printer is thus exposed.

Some of image recording apparatuses such as inkjet printers and laser printers are equipped with sheet tray assemblies such as sheet-supplying cassettes. The sheet tray assembly is provided for accommodating recording sheets each of which is to be subjected to an image recording operation, and is detachably disposed in the image recording apparatus. The sheet tray assembly has a tray unit and a cover unit. The tray unit has an upper opening for allowing the recording sheets to be introduced into the tray unit via the upper opening. The cover unit is disposed on an upper side of the tray unit to cover a rear side region of the upper opening of the tray unit, and is pivotable relative to the tray unit about a pivot axis. A front side region of the upper opening of the tray unit is uncovered, because a pickup roller is disposed in the front side region of the upper opening so as to be held in pressing contact with the recording sheets accommodated in the tray unit. The pivot axis is located in the upper opening of the tray unit. When the cover unit is opened, the rear side region of the upper opening of the tray unit is uncovered, and the recording sheets can be accommodated in the tray unit by introducing leading ends of the respective recording sheets into the tray unit via a space defined on a lower side of the pivot axis.

In the above-described conventional sheet tray assembly, since the pivot axis (about which the cover unit is pivotable) is located in the upper opening of the tray unit, a proximal end portion of the cover unit which is in the vicinity of the pivot axis enters into the tray unit when the cover unit is opened. Therefore, the above-described space defined on the lower side of the pivot axis is reduced when the cover unit is opened, thereby causing a problem that only a limited number of sheets (e.g., recording sheets) can be introduced into the tray unit via the recued space, namely, only a limited number of sheets can be accommodated in the tray unit. In other words, there is a problem that the entrance of the proximal end portion of the cover unit into the tray unit causes a dead space within the tray unit wherein the dead space is not available for accommodation of the sheets. It might be possible to solve the problem, for example, by heightening a position of the pivot axis. However, heightening the position of the pivot axis causes another problem that the image recording apparatus as a whole is increased in size. Anyway, it has been difficult to utilize an entirety of inner space of the sheet tray assembly as a space available for accommodating therein the sheets.

SUMMARY OF THE INVENTION

The present invention was made in view of the background prior art discussed above. It is therefore an object of the invention to provide a sheet tray assembly having an arrangement effective to enable an entirety of inner space of the tray assembly to be utilized as a space available for accommodating sheets therein, without increasing a size of an image recording apparatus (in which the sheet tray assembly is to be detachably disposed).

The above object may be achieved according to a principle of the invention, which provides a sheet tray assembly that is to be detachably disposed in an image recording apparatus. The tray assembly includes: (a) a tray unit configured to accommodate sheets, and having an upper opening for allowing the sheets to be introduced into the tray unit via the upper opening, the upper opening being sectioned into first and second regions such that a front end of the tray unit is closer to the first region than to the second region while a rear end of the tray unit is closer to the second region than to the first region; (b) a cover unit configured to cover the second region of the upper opening at least when the sheet tray assembly is disposed in the image recording apparatus; and (c) a link interconnecting the tray unit and the cover unit, and having (c-1) a first end portion at which the link is pivotably connected to the tray unit and (c-2) a second end portion at which the link is pivotably connected to a proximal end portion of the cover unit, wherein the link is movable between first and second pivot positions relative to the tray unit as a result of pivot movement of the link relative to the tray unit, whereby a posture of the link relative to the tray unit is changeable by the pivot movement, such that the second end portion of the link is placed in a first height level when the link is positioned in the first pivot position, and is placed in a second height level that is higher than the first height level when the link is positioned in the second pivot position.

The upper opening of the tray unit is sectioned into the first and second regions. The second region of the upper opening is covered by the cover unit at least when the sheet tray assembly is disposed in the image recording apparatus. When the sheet tray assembly is disposed in the image recording apparatus, for example, a roller is positioned in the first region and is held in pressing contact with the sheets accommodated in the tray unit, so that the sheets are supplied to the image recording apparatus by rotation of the roller.

In the sheet tray assembly, the tray unit and the link are connected to each other and is pivotable relative to each other, and the link and the cover unit are connected to each other and is pivotable relative to each other. When the cover unit is opened to uncover the second region, the link is moved from the first pivot position to the second pivot position whereby the proximal end portion of the cover unit is displaced upwardly together with the second end portion of the link (at which the link is pivotably connected to the proximal end portion of the cover unit). The upward displacement of the proximal end portion of the cover unit leads to an upward expansion of a space available for introduction of the sheets into the tray unit via the second region of the upper opening of the tray unit. Therefore, without having to increase a vertical dimension of the sheet tray assembly, it is possible to obtain a sufficient amount of space defined on a lower side of the proximal end portion of the cover unit or the second end portion of the link, which is required for introducing the sheets into the tray unit.

BRIEF DESCRIPTION OF THE DRAWINGS

The above and other objects, features, advantages and technical and industrial significance of the present invention will be better understood by reading the following detailed description of presently preferred embodiment of the invention, when considered in connection with the accompanying drawings, in which.

DETAILED DESCRIPTION OF THE PREFERRED EMBODIMENTS

There will be described an embodiment of the present invention, by reference to the accompanying drawings. It is noted that the embodiment will be described for illustrative purpose only and that the invention may be embodied with various changes, modifications and improvements, which may occur to those skilled in the art, without departing from the spirit of the invention defined in the appended claims.

Figure 1:
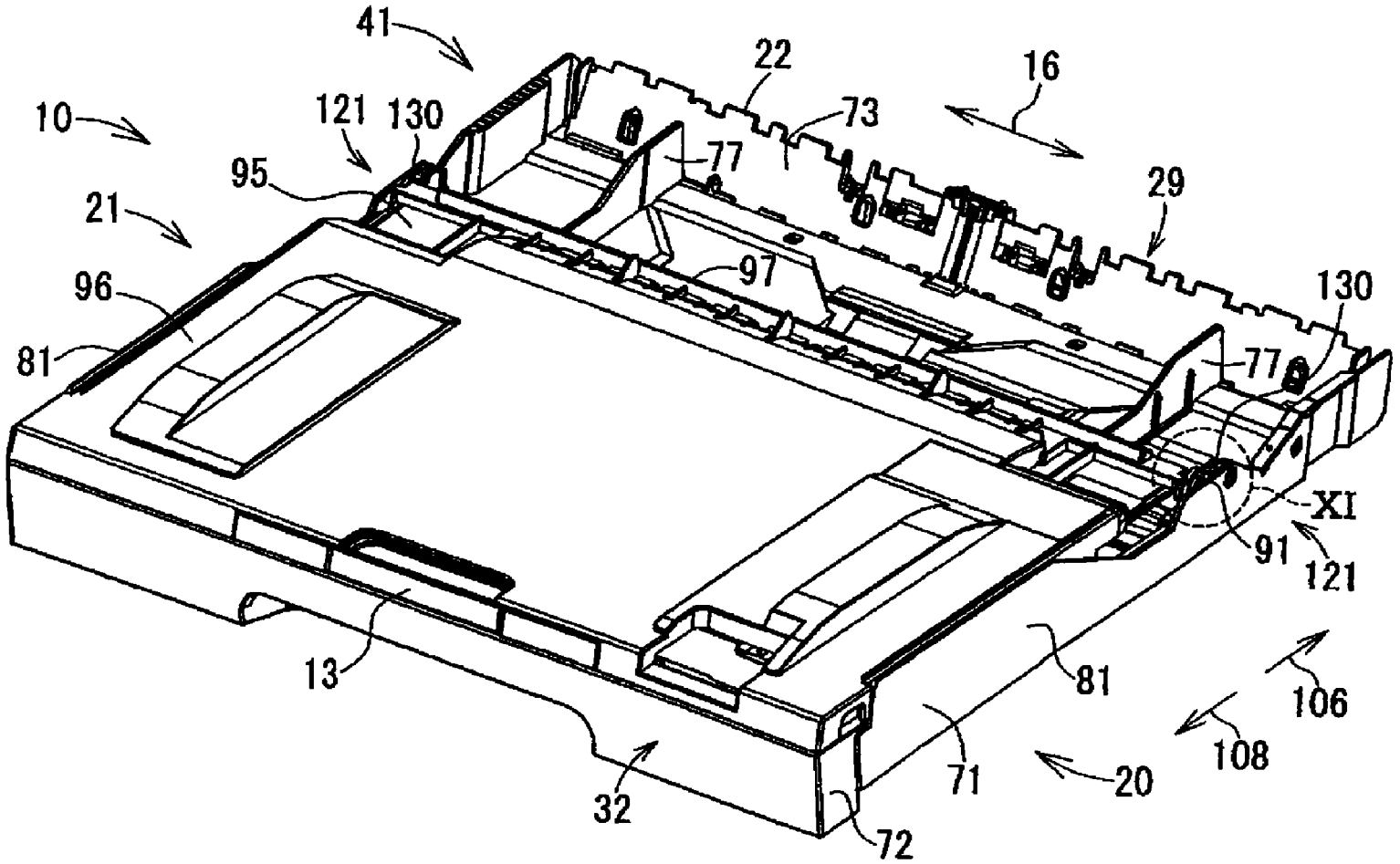
FIG. 1 is a perspective view showing a sheet-supplying cassette 10 in a state in which the cassette 10 is contracted.
Figure 2:
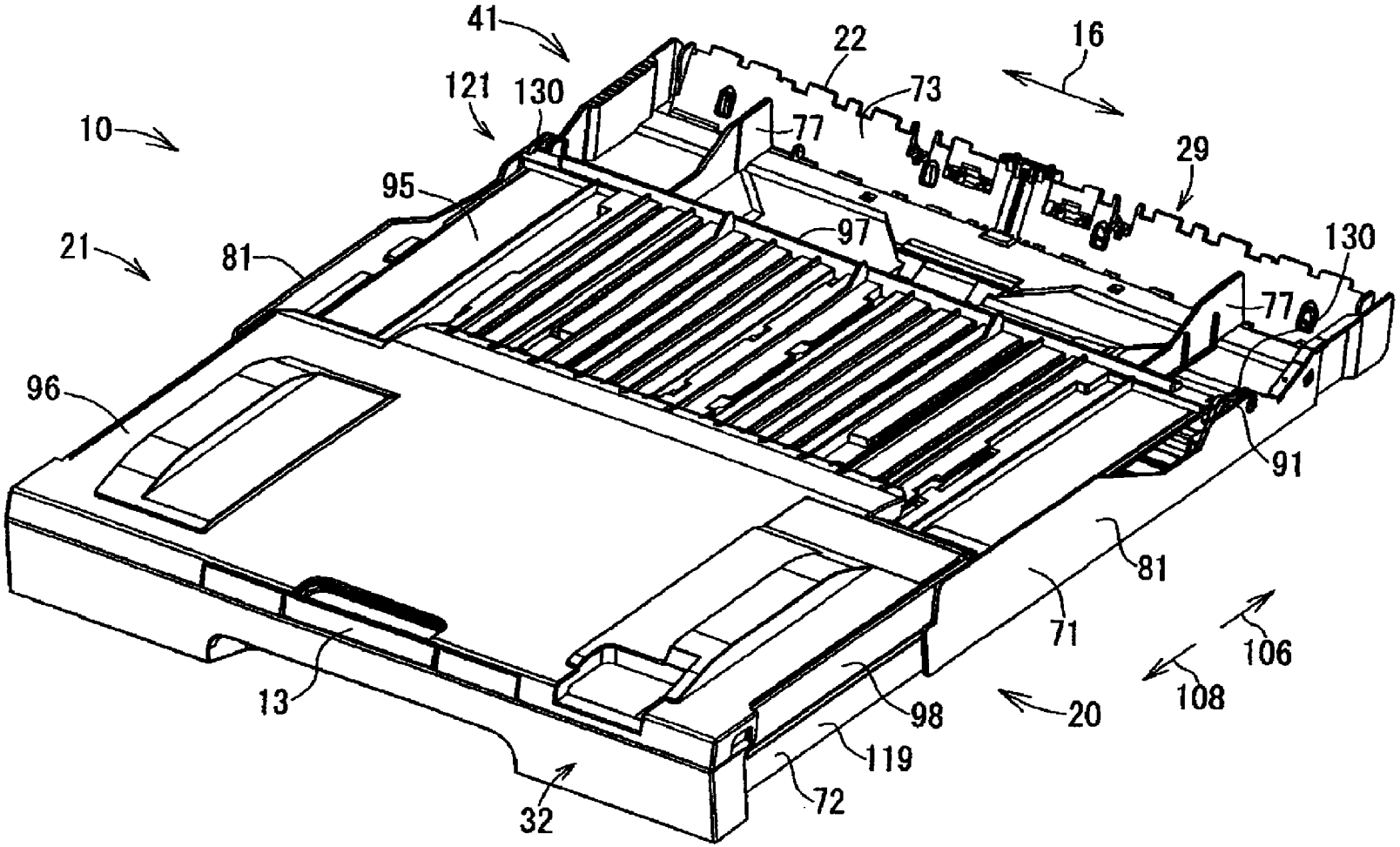
FIG. 2 is a perspective view showing the sheet-supplying cassette 10 in a state in which the cassette 10 is expanded.
Figure 3:
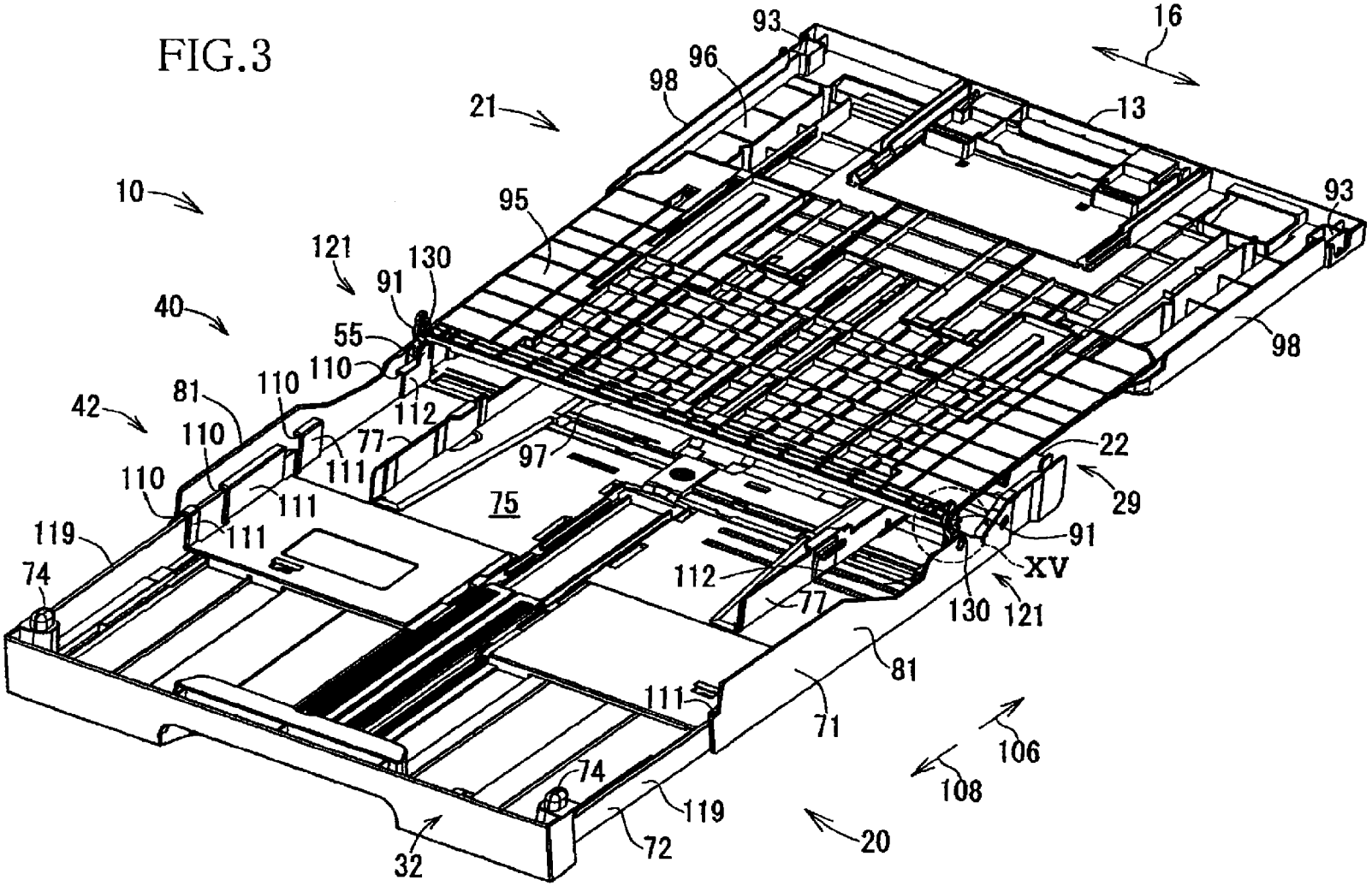
FIG. 3 is a perspective view showing the sheet-supplying cassette 10 in a state in which a sheet exit tray 21 has been pivoted toward a front end 29 of a sheet supply tray 20.

Referring first to FIGS. 1-3, there will be described a sheet tray assembly in the form of a sheet-supplying cassette 10 that is constructed according to the embodiment of the invention. The sheet-supplying cassette 10 is provided for accommodating recording sheets (as examples of sheets). The sheet-supplying cassette 10 is constituted by a double-deck tray assembly including upper and lower portions that are provided by a sheet exit tray 21 as a cover unit and a sheet supply tray 20 as a tray unit, respectively.

The sheet supply tray 20 serves to hold the recording sheets each of which is to be subjected to an image recording operation. The sheet supply tray 20 is capable of holding various kinds of recording sheets having various sizes, which are defined by Japanese Industrial Standard (JIS), such as A3-sized sheet A4-sized sheet, B5-sized sheet and postcard-sized sheet. The sheet supply tray 20 is expandable and contractible in an introducing direction 106 and a drawing direction 108, depending on a selected one of the various kinds of recording sheets that are to be held by the sheet supply tray 20. The introducing direction 106 is a direction in which the sheet-supplying cassette 10 is to be introduced into the printer 100 via an opening 105 (see FIG. 4). The drawing direction 108 is a direction in which the sheet-supplying cassette 10 is to be drawn out of the printer 100 via the opening 105. The sheet supply tray 20 has an upper opening 40 for allowing the recording sheets to be introduced into the sheet supply tray 20 via the upper opening 40. The upper opening 40 is sectioned into first and second regions 41, 42 such that a front end 29 of the sheet supply tray 20 is closer to the first region 41 than to the second region 42 while a rear end 32 of the sheet supply tray 20 is closer to the second region 42 than to the first region 41.

The sheet exit tray 21 serves to receive the recording sheets each of which has been subjected to the image recording operation. The sheet exit tray 21 is pivotable relative to the sheet supply tray 20, about a pivot axis that is parallel to a width direction 16 of the sheet supply tray 20. When the sheet exit tray 21 lies down on the sheet supply tray 20, as shown in FIGS. 1 and 2, the sheet exit tray 21 covers the second region 42 of the upper opening 40 of the sheet supply tray 20. In the present embodiment, the second region 42 is located on one of opposite sides of a second shaft in the form of shafts 91 (see FIG. 11) of the sheet exit tray 21 that is closer to the rear end 32 of the sheet supply tray 20, than the other of the opposite sides of the second shaft. In this state in which the sheet exit tray 21 lies down on the sheet supply tray 20, the sheet exit tray 21 holds the recording sheets each of which has been already subjected to the recording operation while functioning as the cover unit.

When the sheet exit tray 21 has been pivoted toward the front end 29 of the sheet supply tray 20, as shown in FIG. 3, the sheet exit tray 21 covers the first region 41 of the upper opening 40 of the sheet supply tray 20. In the present embodiment, the first region 41 is located on the other of the above-described opposite sides of the second shaft (in the form of shafts 91 of the sheet exit tray 21) that is closer to the front end 29 of the sheet supply tray 20, than the above-described one of the opposite sides of the second shaft. In this state in which the sheet exit tray 21 has been pivoted toward the front end 29 of the sheet supply tray 20, the second region 42 of the upper opening 40 is uncovered while the first region 41 of the upper opening 40 is covered, as shown in FIG. 3, so that the recording sheets can be introduced into the sheet supply tray 20 via the uncovered second region 42. In the above-described state in which the sheet exit tray 21 lies down on the sheet supply tray 20, as seen in FIGS. 1 and 2, the first region 41 is uncovered for permitting a pickup roller 25 and an arm 26 to be disposed on an upper side of the sheet supply tray 20 (see FIG. 5).

Figure 4:
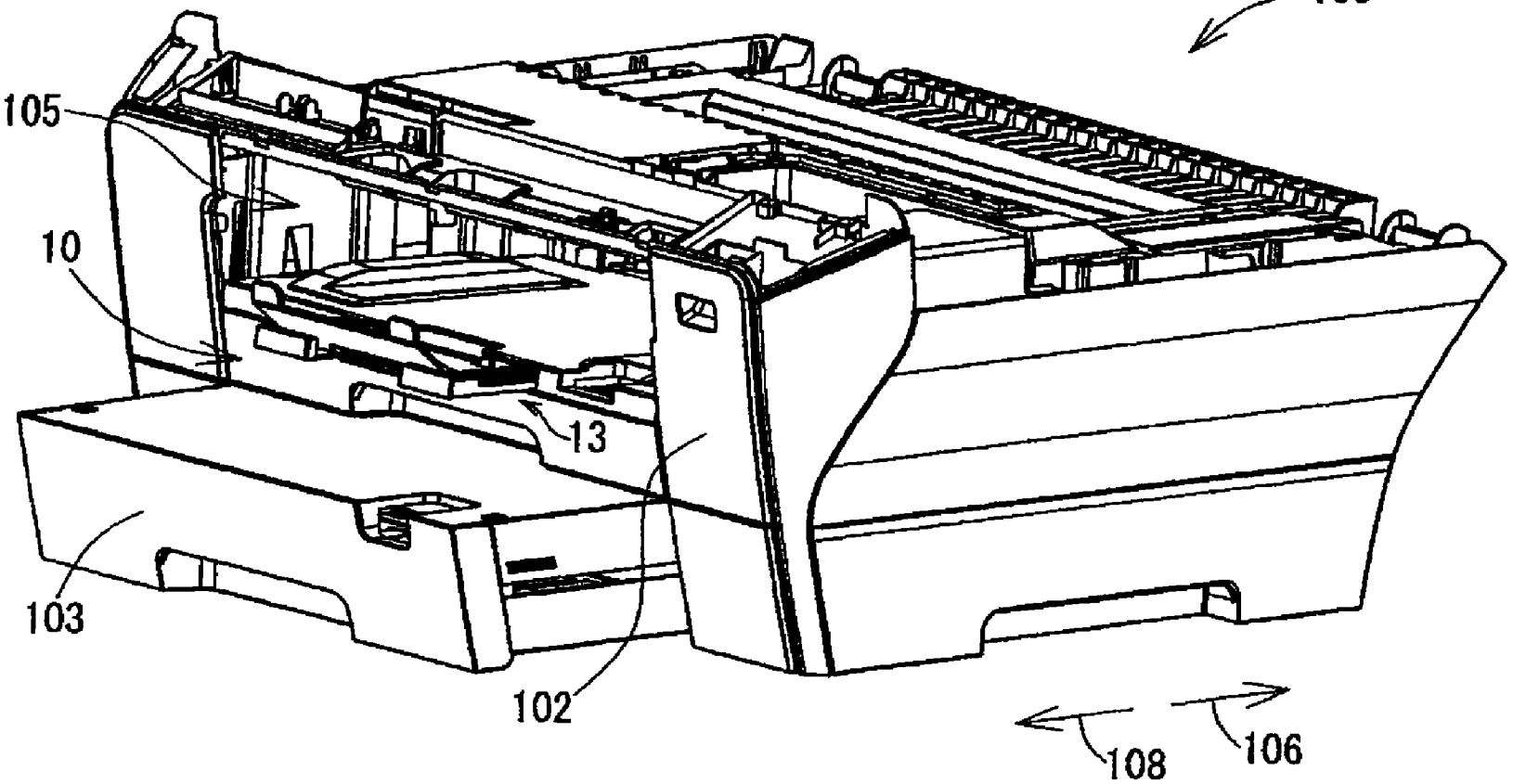
FIG. 4 is a perspective view showing an inkjet head printer 100 in which the sheet-supplying cassette 10 is disposed.

The sheet-supplying cassette 10 having the sheet supply tray 20 and the sheet exit tray 21 is detachably disposed in the printer 100, so as to be used. As shown in FIG. 4, the printer 100 has the opening 105 opening in its front side surface 102, thereby making it possible to introduce and remove the sheet-supplying cassette 10 into and from the printer 100 via the opening 105. Specifically described, the sheet-supplying cassette 10 is introduced into the printer 100, by first inserting the front end 29 via the opening 105 in the introducing direction 106. With the introduction of the sheet-supplying cassette 10 in the printer 100, the cassette 10 is positioned in a predetermined position inside the printer 100 (see FIG. 4) so that the recording sheets accommodated in the sheet supply tray 20 can be supplied to the printer 100. The sheet-supplying cassette 10 is drawn in the drawing direction 108 via the opening 105, so as to be removed from the printer 100. With the removal of the sheet-supplying cassette 10 from the printer 10, the sheet supply tray 20 can be replenished with recording sheets. It is noted that the printer 10 is an inkjet multifunction apparatus including an image reader (FB scanner unit equipped with an automatic document feeder) that is provided by an upper portion of the multifunction apparatus, and that FIG. 4 shows a state in which the image reader is removed from a main body of the multifunction apparatus.

As shown in FIG. 4, a lower tray 103 is disposed on a lower side of the sheet-supplying cassette 10 that is disposed in the printer 100. The lower tray 103 accommodates the recording sheets each of which is to be subjected to the image recording operation. In the present embodiment, the recording sheets are supplied to the printer 100 from a selected one of the sheet supply tray 20 and the lower tray 103, so that the image recording operation is performed onto each of the supplied recording sheets. The construction of the lower tray 103 will not be described in detail, since it is substantially the same as the construction of the sheet supply tray 20 that will be described later.

Figure 5:
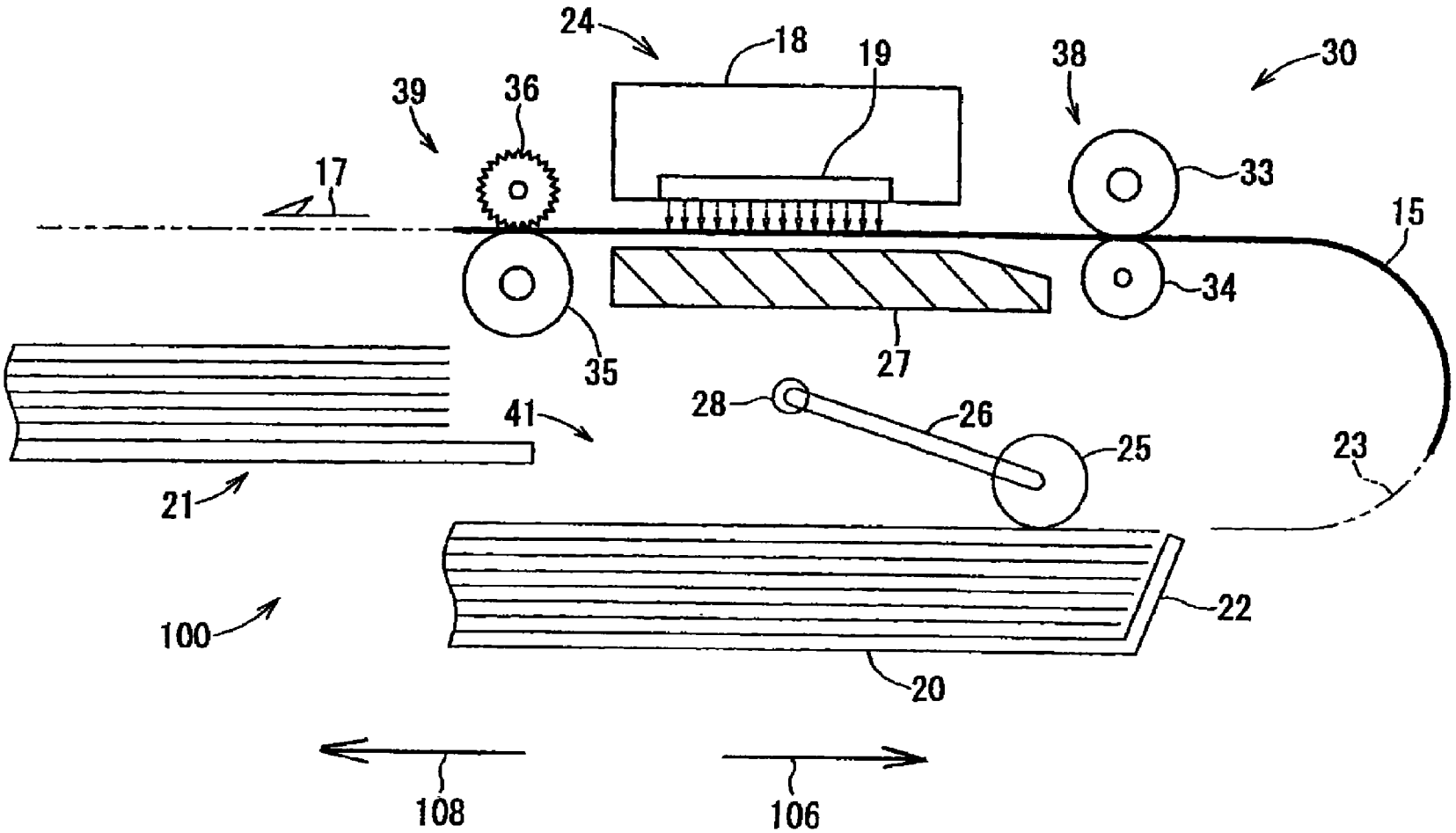
FIG. 5 is a view schematically showing an internal construction of the printer 100.

There will be described a construction of the printer 100. When the sheet-supplying cassette 10 is disposed in the printer 100, the slant plate 22 of the sheet supply tray 20 is positioned below a sheet path 23. The slant plate 22 is inclined toward the rear side of the printer 100, i.e., rightward as seen in FIG. 5. The recording sheets accommodated in the sheet supply tray 20 are guided upwardly along the slant plate 22 so as to be supplied to the sheet path 23. The sheet path 23 is a path along which the recording sheets are to be conveyed, and includes a curved portion. Specifically described, after extending upwardly from the slant plate 22, the sheet path 23 is curved to be directed toward the front side of the printer 100, and extends to the sheet exit tray 21 via an image recorder 24.

When the sheet-supplying cassette 10 is disposed in the printer 100, the pickup roller 25 is positioned above the sheet supply tray 20, as shown in FIG. 5. As described above, the first region 41 of the upper opening 40 is uncovered for permitting the pickup roller 25 to be positioned on the upper side of the sheet supply tray 20. An arm 26 is pivotably held by a shaft 28 that is supported by a frame (not shown) of the printer 100. The pickup roller 25 is pivotably held by a distal end portion of the arm 26. The arm 26 is constantly forced, by its own weight or an elastic force generated by a spring or the like, to be pivoted toward the sheet supply tray 20. A drive force generated by the motor (not shown) is transmitted to the pickup roller 25 through a power transmission mechanism (not shown) that is provided in the shaft 28 and the arm 26. When the drive force is transmitted to the pickup roller 25 with the pickup roller 25 being held in contact with an uppermost one of the recording sheets held by the sheet supply tray 20, the uppermost recording sheet is picked up by the pickup roller 25 and then supplied to the sheet path 23. It is noted that the arm 26 and the pickup roller 25 are upwardly retracted when the sheet-supplying cassette 10 is to be removed from the main body of the printer 100 via the opening 105 (see FIG. 4).

A platen 27 is provided on a downstream side (i.e., left side as seen in FIG. 5) of the above-described curved portion of the sheet path 23 in a conveying direction 17 in which each recording sheet 15 is to be conveyed. The platen 27 supports the recording sheet 15 (that is being conveyed along the sheet path 23) from a lower side of the sheet 15. The image recorder 24 is disposed above the platen 27, so as to record an image onto the recording sheet 15 conveyed along the sheet path 23. The image recorder 24 includes an inkjet recording head 19 and a carriage 18 that carries the recording head 19. The carriage 18 is movable in a horizontal direction (i.e., in a direction perpendicular to a drawing sheet of FIG. 5) that is perpendicular to the conveying direction 17. The recording head 19 is disposed on a bottom surface of the carriage 18 such that nozzles of the recording head 19 are exposed in the bottom surface of the carriage 18 and face downwardly. An ink is supplied to the recording head 19 from each ink cartridge (not shown) that is disposed inside the printer 100. While the carriage 18 is being moved, the recording head 19 ejects the ink in the form of minute droplets, through selected ones of the nozzles, toward the platen 27, so that a desired image is formed onto the recording sheet 15 that is being conveyed on an upper side of the platen 27 along the sheet path 23.

A sheet conveyor 30, which is provided in the sheet path 23, includes a pair of feeding roller set 38 and a pair of discharging roller set 39. The feeding roller set 38 is disposed on an upstream side of the image recorder 24 in the conveying direction 17, and consists of a feeding roller 33 and a pinch roller 34. The pinch roller 34 is freely rotatably held, and is constantly forced or biased toward the feeding roller 33 by a spring or the like. The discharging roller set 39 is disposed on a downstream side of the image recorder 24 in the conveying direction 17, and consists of a discharging roller 35 and a spur roller (rowel) 36. The spur roller 36 is freely rotatably held, and is constantly forced or biased toward the discharging roller 35 by a spring or the like.

A gear drive mechanism (not shown) including a plurality of gears is connected to a shaft of the feeding roller 33, so that the rotary drive force generated by the motor is transmitted to the shaft of the feeding roller 33. By the transmission of the drive force to the shaft of the feeding roller 33, the feeding roller 33 is rotated at a certain rotational velocity whereby the recording sheet 15 gripped between the feeding roller 33 and the pinch roller 34 is fed onto the platen 27. The feeding roller 33 and the discharging roller 35 are connected to each other via a transmission mechanism that includes gears, so that the drive force is transmitted from the feeding roller 33 to the discharging roller 35 via the transmission mechanism whereby the feeding and discharging rollers 33, 35 are driven in synchronization with each other. Thus, the recording sheet 15 gripped between the discharging roller 35 and the spur roller 36 is moved in the conveying direction 17 so as to be discharged onto the sheet exit tray 21 via the sheet path 23. The recording sheet 15 supplied from the sheet supply tray 20 is subjected to a recording operation while being conveyed along the sheet path 23 above the platen 27 by the feeding roller set 38 and the discharging roller set 39, and is then received onto the sheet exit tray 21.

Figure 6:
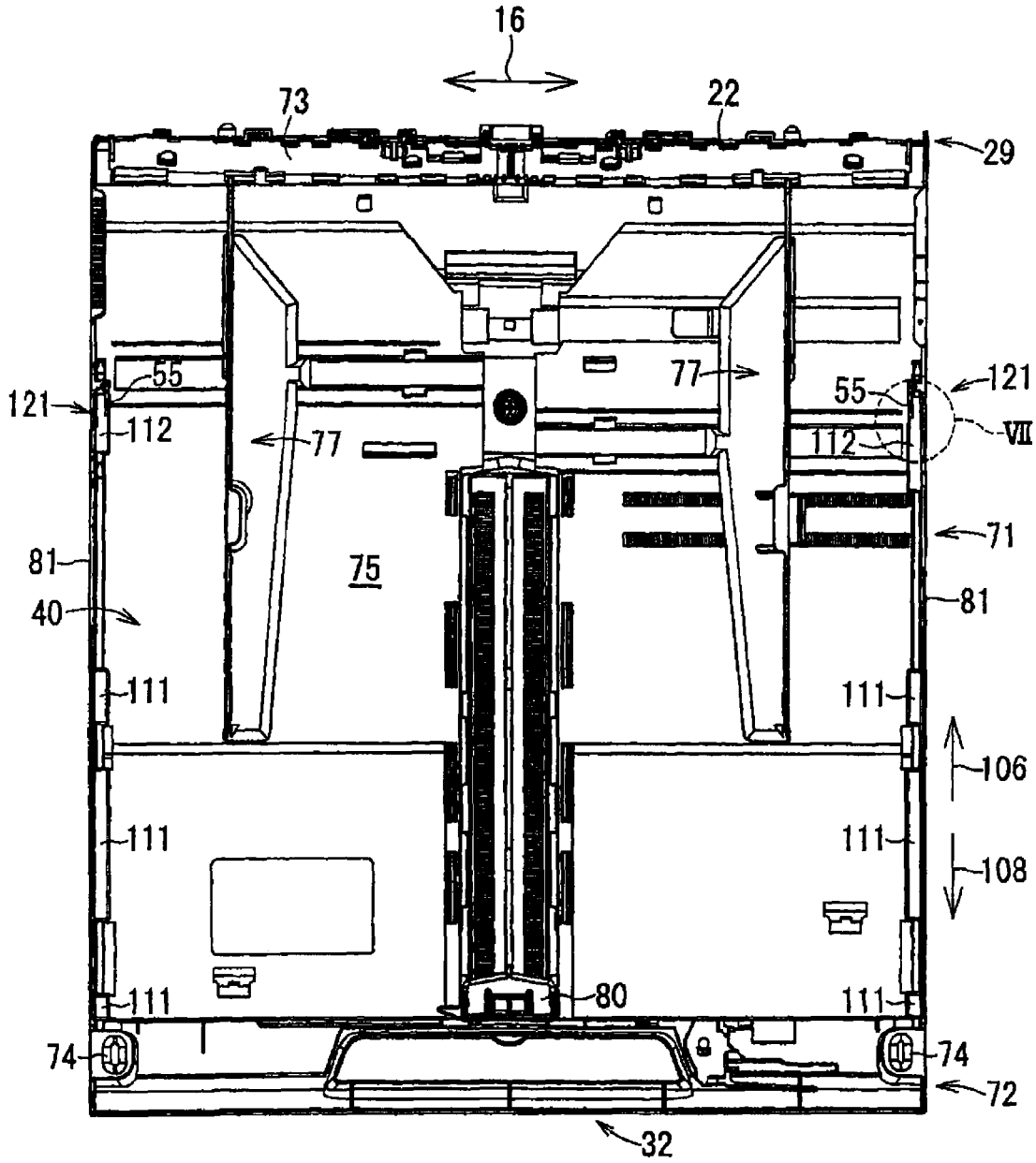
FIG. 6 is a plan view showing the sheet supply tray 20 in a state in which the tray 20 is contracted.

The sheet-supplying cassette 10 is constituted principally by the above-described sheet supply tray 20 and sheet exit tray 21 and a link 130 that interconnects the sheet supply tray 20 and sheet exit tray 21. There will be described a construction of the sheet supply tray 20. As shown in FIGS. 3 and 6, the sheet supply tray 20 has a rectangular plate-like shape that is elongated in the introducing direction 106 and drawing direction 108. The sheet supply tray 20 has a tray main body 71 and an expansion tray 72 that is slidingly movable relative to the tray main body 71 in the introducing direction 106 and drawing direction 108. Thus, the expansion tray 72 is slidingly moved relative to the tray main body 71 as needed in the introducing direction 106 or drawing direction 108. By the movement of the expansion tray 72 relative to the tray main body 71, an upper surface (i.e., a sheet receiving surface) of the sheet supply tray 20 is expanded or contracted so that the sheet supply tray 20 can hold various kinds of recording sheets that are different in size.

The tray main body 71 of the sheet supply tray 20 has a bottom plate 75 (see FIG. 5) on which recording sheets are to be set. The above-described slant plate 22 is provided in an end portion of the bottom plate 75 that constitutes the front end 29 of the sheet supply tray 20. The slant plate 22 is provided by a plate-like member that is elongated in the width direction 16 (i.e., a direction perpendicular to the conveying direction 17) of the tray main body 71. The slant plate 22 is inclined in the introducing direction 106, i.e., in the direction toward the rear side of the printer 100, as described above. When each of the recording sheets accommodated in the sheet supply tray 20 is brought into contact at its leading end with the slant plate 22, the leading end of each sheet is guided along an inside surface 73 of the slant plate 22 in a diagonally upward direction toward the sheet path 23.

A pair of side guide plates 77 are provided in the tray main body 71, as shown in FIGS. 3 and 6. When one of the side guide plates 77 is slidingly moved in a direction parallel to the width direction 16, the other of the side guide plates 77 is slidingly moved in a direction opposite to the direction of the movement of the one of side guide plates 77. That is, the pair of side guide plates 77 are moved in association with each other in respective opposite directions that are parallel to the width direction 16. For example, where the recording sheets set on the sheet supply tray 20 have a width smaller than a distance between the two side guide plates 77, it is possible to cause the two side guide plates 77 to be moved toward each other concurrently with each other, by moving one of the two side guide plates 77 toward the recording sheets. Owing to the movements of the respective two side guide plates 77, it is possible to substantially align a widthwise center of the recording sheets with a widthwise center of the sheet supply tray 20.

The tray main body 71 further has a pair of side walls 81 that are provided on respective end portions of the bottom plate 75 that are opposite to each other in the width direction 16, as shown in FIGS. 3 and 6. The side walls 81, each corresponding to an end wall of the sheet supply tray 20, extend in the introducing direction 106 and drawing direction 108. The side walls 81 are spaced apart from each other in the width direction 16 by such a distance that permits the side walls 81 to be located outside a pair of side walls 98 of an expansion tray 96 of the sheet exit tray 21 in the width direction 16 (see FIG. 2).

A plurality of side end guides 111, 112 are provided inside the side walls 81 of the tray main body 71, and are arranged in the introducing direction 106, as shown in FIG. 3. Each of the side end guides 111, 112 has a guide groove 110, so as to have an inverted U shape in its cross section. By the guide groove 110, directions of the sliding movement of the expansion tray 72 are limited to the introducing direction 106 and drawing direction 108. The expansion tray 72 has a pair of rails 119 that are introduced in the guide grooves 110 of the side end guides 111, 112.

As shown in FIG. 6, a rear guide 80 is provided in a central portion of the expansion tray 72 in the width direction 16, so as to be slidingly movable in the introducing direction 106 and drawing direction 108. When the recording sheets are accommodated in the sheet supply tray 20, the rear guide 80 is slidingly moved in the introducing direction 106 so as to be brought into contact with trailing ends of the respective recording sheets. Owing to the rear guide, the trailing ends of the respective recording sheets are made flush with each other and are all positioned in a position that is dependent on a size of the recording sheets, while leading ends of the respective recording sheets are all positioned in a predetermined position close to the slant plate 22 within the sheet supply tray 20, irrespective of the size of the recording sheets.

The above-described pair of rails 119 are provided in respective end portions of the expansion tray 72 which are opposite to each other in the width direction 16, so as to be introduced in the guide grooves 110 of the tray main body 71 (see FIG. 3). The rails 119 extend in the introducing direction 106, and constitute respective side walls of the expansion tray 72. Each of the rails 119 is positioned in a suitable position and has a suitable shape for enabling itself to be introduced in the guide grooves 110.

As shown in FIGS. 3 and 6, a pair of protrusions 74 are provided in respective opposite end portions of the rear end 32 of the expansion tray 72 which are opposite to each other in the width direction 16. The protrusions 74 protrude upwardly from the expansion tray 72, and are receivable in respective recesses 93 of the expansion tray 96 of the sheet exit tray 21. Each of the protrusions 74 is positioned in a suitable position and has a suitable shape for enabling itself to be received in a corresponding one of the recesses 93.

Figure 7:
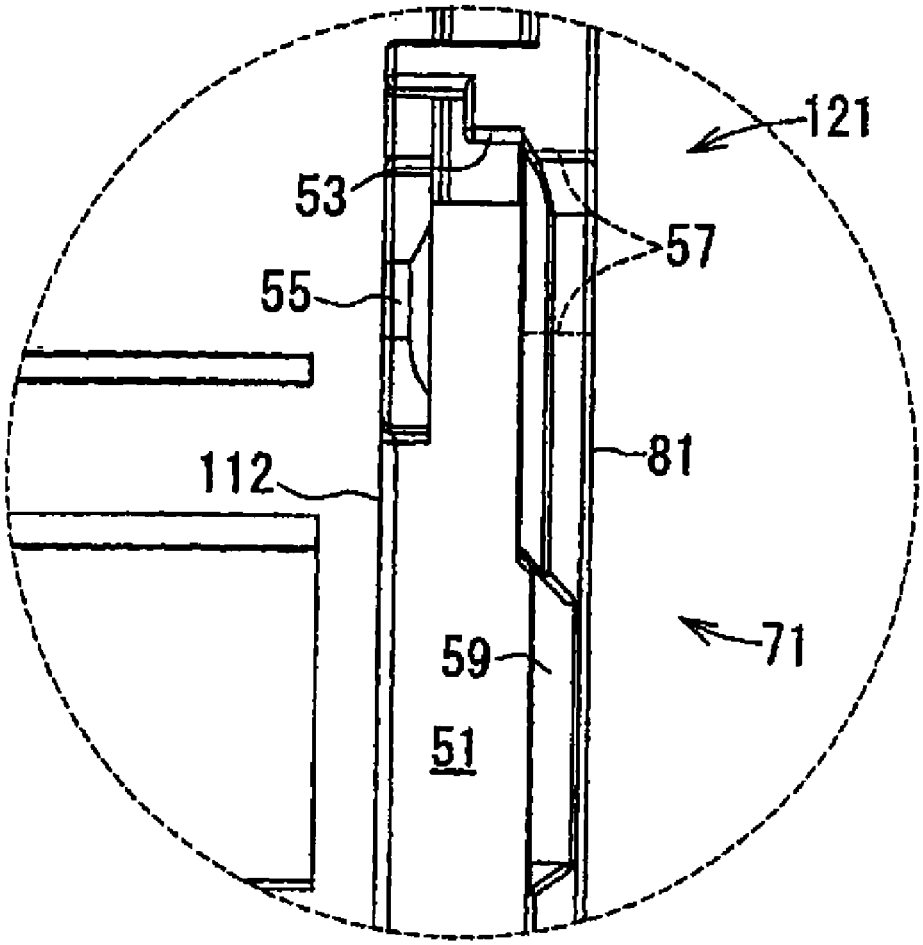
FIG. 7 is a view showing, in enlargement, a part VII of FIG. 6.

Above the respective side end guides 112, a pair of support portions 121 are provided such that the links 130 are pivotably supported by the respective support portions 121, as shown in FIGS. 6 and 7. The support portions 121 are constituted principally by the respective side walls 81, inside walls 55, receiver holes 57 (see FIGS. 9 and 11) as second holes, support surfaces 51, guide surfaces 59 and second protrusions 53.

Figure 9:
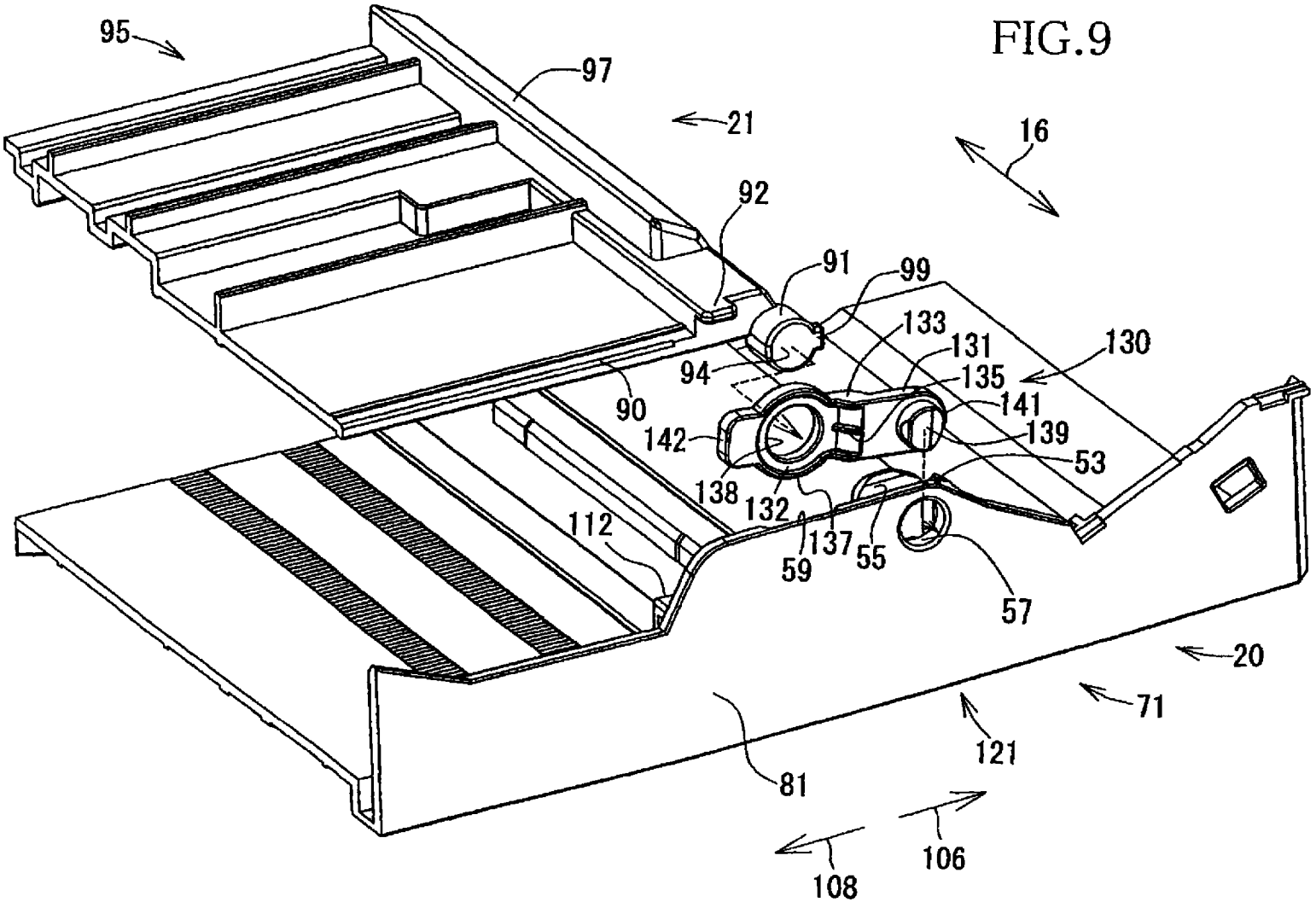
FIG. 9 is an exploded perspective view of a part of the sheet-supplying cassette 10, showing an arrangement for connection of the sheet exit tray 21 and the sheet supply tray 20 via a link 130.
Figure 11:
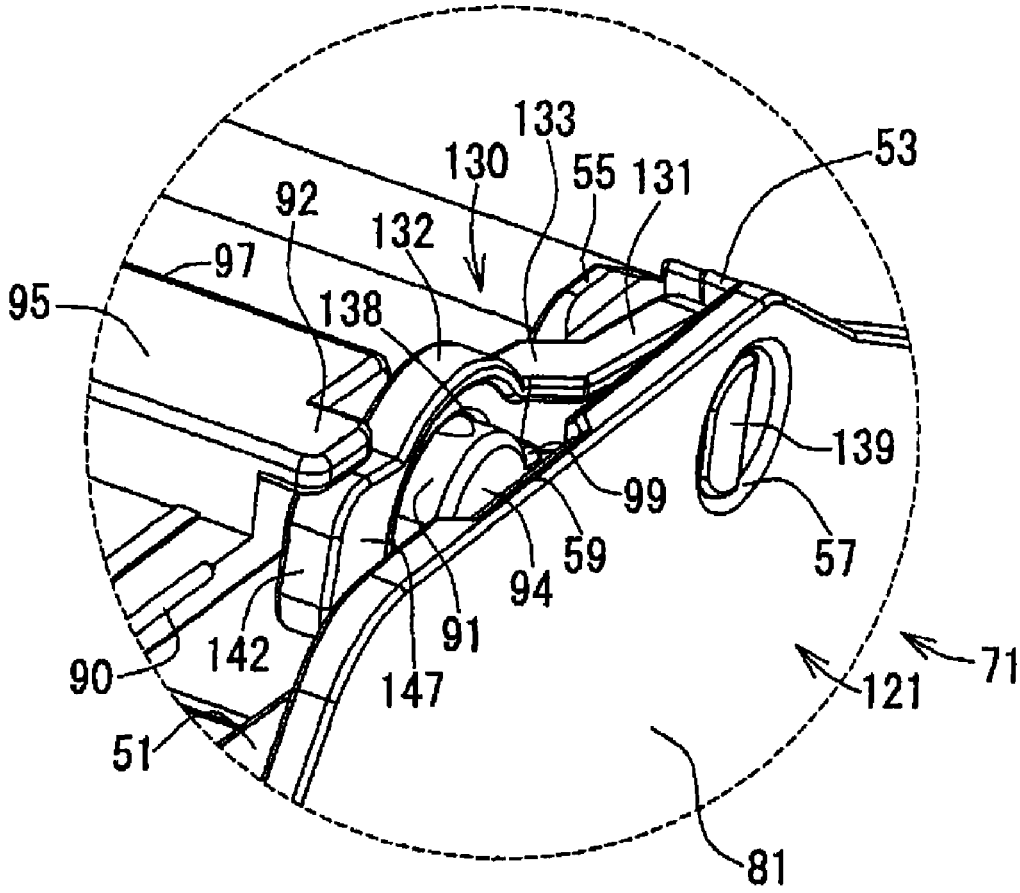
FIG. 11 is a view showing, in enlargement, a part XI of FIG. 1.

As shown in FIGS. 9 and 11, the links 130 have first shafts in the form of respective shafts 139 that are rotatably received in the respective receiver holes 57. Each of the receiver holes 57 has an inside diameter that is slightly larger than an outside diameter of a corresponding one of the shafts 139, for thereby allowing the shafts 139 to be smoothly rotated. As shown in FIG. 9, each of the receiver holes 57 is provided in the vicinity of an upper end of a corresponding one of the side walls 81, so that the shafts 91 of the sheet exit tray 21 are moved more upwardly upon pivot movements of the respective links 130 relative to the sheet supply tray 20, than in an arrangement in which each of the receiver holes 57 is provided in the vicinity of a lower end of a corresponding one of the side walls 81. Further, the receiver holes 57 are provided in respective positions that are distant from the front end 29 of the sheet supply tray 20 by a predetermined distance in the drawing direction 108, for thereby obtaining the first region 41 (of the upper opening 40), in the above-described other of the opposite sides of the second shaft (in the form of shafts 91) that is closer to the front end 29 of the sheet supply tray 20, so that the pickup roller 25 and the arm 26 are disposed in the above-described other of the opposite sides of the second shaft. Therefore, each of the receiver holes 57 is positioned in a predetermined position in a longitudinal direction of the sheet supply tray 20 (i.e., the introducing and drawing directions 106, 108), wherein the predetermined position is determined dependent on positions of the pickup roller 25 and the arm 26.

As shown in FIGS. 7 and 9, the pair of inside walls 55 extend uprightly from upper surfaces of the respective side end guides 112. Each of the inside walls 55 is located in a position which is opposed to a corresponding one of the receiver holes 57 (provided in the respective side walls 81) and which is distant from a corresponding one of the side walls 81 by a predetermined distance in the width direction 16. Each of the links 130 has a first portion 131 is located between a corresponding one of the inside walls 55 and a corresponding one of the side walls 81 (see FIG. 11). That is, each of the inside walls 55 is located in the position that enables the inside wall 55 to be in contact with a first surface 144 (see FIG. 10) of the first portion 131 of a corresponding one of the links 130. The predetermined distance between each of the inside walls 55 and a corresponding one of the side walls 81 is smaller than a sum of a thickness of the first portion 131 of a corresponding one of the links 130 and an axial length of the shaft 139 of the corresponding link 130, so that the shafts 139 of the respective links 130 are prevented from being removed from the respective receiver holes 57.

As shown in FIG. 7, the support surface 51 is provided by an upper surface of each of the side end guides 112. The support surface 51 is a surface with which a lower end 137 of a second portion 132 of each of the links 130 is to be brought into contact (see FIG. 9). With the contact of the lower end 137 of the second portion 132 of each link 130 with the corresponding support surface 51, the link 130 is stopped from being pivoted downwardly and is held in a first pivot position in which the link 130 takes a substantially horizontal posture (see FIG. 11).

The guide surfaces 59 (see FIGS. 7 and 8) are located in respective positions corresponding to the shafts 91 of the sheet exit tray 21 in the introducing direction 106, i.e., the longitudinal direction of the sheet supply tray 20 (see FIGS. 9 and 11). Each of the guide surfaces 59 is provided by a portion of a corresponding one of the side walls 81, which is inclined in a diagonally downward direction while extending inwardly in the width direction 16 (see FIG. 11). Owing to the provision of the guide surfaces 59, when being moved downwardly from an upper side of a corresponding one of the side walls 81, each of the shafts 91 (see FIG. 15) is moved toward a corresponding one of the support surfaces 51, without each shaft 91 being mounted on the upper surface of a corresponding one of the side walls 81. That is, the guide surfaces 59 are effective to prevent pivot movements of the links 130 from being impeded by the respective side walls 81.

Each of the second protrusions 53 is provided on one of opposite sides of a corresponding one of the receiver holes 57, which is closer to the front end 29 of the sheet supply tray 20 than the other of the opposite sides of the corresponding receiver hole 57. The second protrusions 53 protrude from the upper surfaces of the respective side walls 81, inwardly in the width direction 16. Each of the second protrusions 53 is disposed in a position lying on a plane that is defined by locus of the pivot movement of a corresponding one of the links 130. As shown in FIG. 9, each of the links 130 has opposite end portions in the form of a first end portion 141 and a second end portion 142. The first end portion 141 of each the links 130 having respective shafts 139 received in the respective receiver holes 57 is covered by a corresponding one of the second protrusions 53 (see FIG. 11). Thus, the links 130 are brought into contact with the respective second protrusions 53 when the links 130 are pivoted in a direction that causes the second end portions 142 to be moved toward the front end 29 of the sheet supply tray 20 (see FIG. 15).

Figure 8:
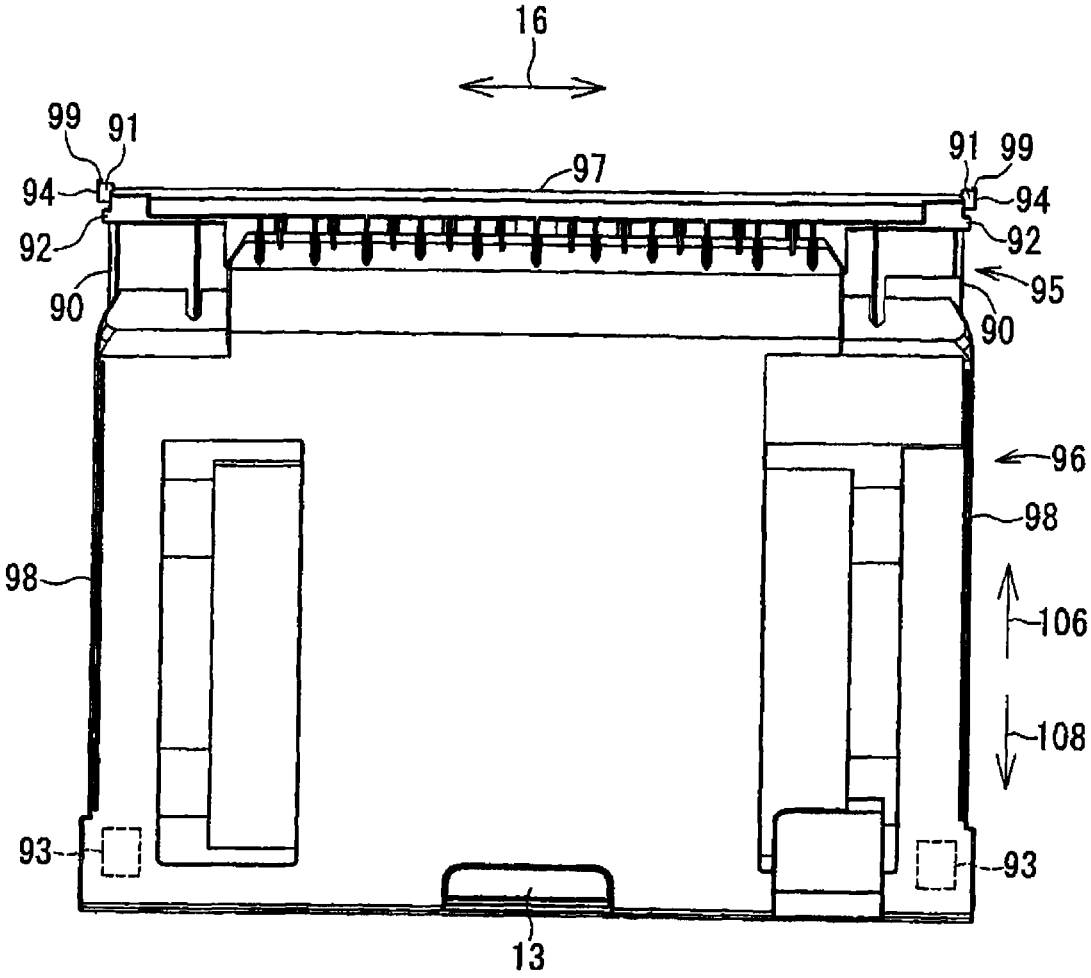
FIG. 8 is a plan view showing the sheet exit tray 21 in a state in which the tray 21 is contracted.

There will be described a construction of the sheet exit tray 21, which includes a tray main body 95 and the above-described expansion tray 96, as shown in FIGS. 2 and 8. The expansion tray 96 is slidingly movable relative to the tray main body 95 in the introducing direction 106 and drawing direction 108.

The tray main body 95 of the sheet exit tray 21 is connected to the tray main body 71 of the sheet supply tray 20 via the links 130, and has a generally rectangular shape, in its plan view, which is elongated in the width direction 16. The tray main body 95 has a width that is smaller than a width of the tray main body 71 of the sheet supply tray 20. Specifically described, the width of the tray main body 95 is smaller than a distance between the two inside walls 55 (see FIGS. 3 and 6) of the sheet supply tray 20 that are opposite to each other in the width direction 16. That is, the width of the tray main body 71 is determined such that each of the links 130 can disposed between a corresponding one of the side walls 81 and a corresponding one of side ends 90 of the tray main body 95 in the width direction 16 of the sheet supply tray 20. Therefore, the tray main body 95 of the sheet exit tray 21 is disposed inside the sheet supply tray 20 in the width direction 16 of the sheet supply tray 20, with each of the links 130 being interposed between the tray main body 95 and the sheet supply tray 20 in the width direction 16.

The above-described shafts 91 of the sheet exit tray 21 are located in a front end portion 97 (i.e., proximal end portion) (see FIG. 9) of the tray main body 95, and extend from respective opposite ends of the front end portion 97, outwardly in the width direction 16. Each of the shafts 91 is introduced into a receiver hole 138 as a first hole of a corresponding one of the links 130, from the side of a second surface 145 (see FIG. 10) of the second portion 132 of the corresponding link 130 (see FIG. 11). Each of the shafts 91 has an outside diameter that is slightly smaller than an inside diameter of a corresponding one of the receiver holes 138 of the respective links 130, so as to be rotatably received in the corresponding receiver hole 138. Each of the shafts 91 has such an axial length (i.e., length in the width direction 16) that its axially distal end portion 94 is located in a position that is closer to a corresponding one of the side walls 81 of the tray main body 71 than the second portion 132 of a corresponding one of the links 130. That is, in a state in which the shafts 91 are received in the respective receiver holes 138, the axially distal end portion 94 of each shaft 91 protrudes outwardly from the corresponding receiver hole 138 toward the corresponding side wall 81 (see FIG. 11). As shown in FIGS. 9 and 11, a protrusion 99 protrudes from the axially distal end portion 94 of each shaft 91 outwardly in a radial direction of each shaft 91, and has a radially outer end that is located outside the receiver hole 138 in the radial direction. Thus, the shafts 91, which are rotatably received in the respective receiver holes 138, are prevented by the respective protrusions 99 from being removed from the respective receiver holes 138.

Figure 13:
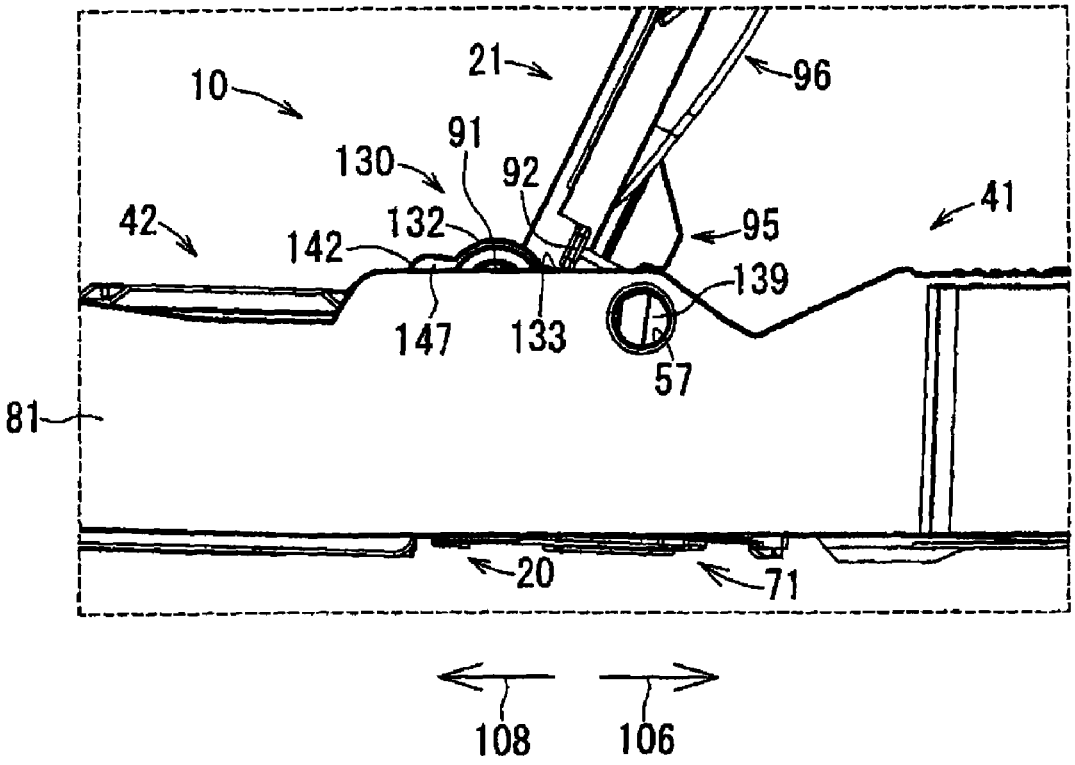
FIG. 13 is a side view showing, in enlargement, the part of the sheet-supplying cassette 10 in a state in which a first protrusion 92 provided in the sheet exit tray 21 is in contact with a bent portion 133 of the link 130.

A pair of first protrusions 92 are provided in the front end portion 97 of the tray main body 95 of the sheet exit tray 21, and extend from respective opposite ends of the front end portion 97, outwardly in the width direction 16. Each of the first protrusions 92 extends from an upper surface of a corresponding one of the opposite ends of the front end portion 92 toward an upper side of a corresponding one of the side walls 81, more precisely, to an upper side of a distal end portion 147 of the second portion 132 of a corresponding one of the links 130 (see FIG. 11). When the sheet exit tray 21 is pivoted relative to the links 130, the first protrusions 92 can be brought into contact with the distal end portions 147 of the respective links 130 or with the upper surfaces of bent portions 133 of the respective links 130 (see FIGS. 11 and 13).

The expansion tray 96 of the sheet exit tray 21 has a generally rectangular shape, in its plan view, which is elongated in the width direction 16. A width of the expansion tray 96 is slightly smaller than a distance between the side walls 81 of the tray main body 71, so that inside surfaces of respective side walls 98 of the expansion tray 96 are brought into contact with upper surfaces of the respective side end guides 111 so as to be supported from their lower sides by the upper surfaces of the respective side end guides 111, when the sheet exit tray 21 lies down on the sheet supply tray 20.

As shown in FIG. 3, the above-described recesses 93 are provided in respective opposite end portions of a rear end portion of the expansion tray 96 which are opposite to each other in the width direction 16. The recesses 93 are recessed from a bottom surface of the expansion tray 96 toward an upper surface of the expansion tray 96. Each of the recesses 93 is positioned in a suitable position and has a suitable shape for enabling itself to receive therein a corresponding one of the above-described protrusions 74, so that the protrusions 74 are received in the respective recesses 93 when the sheet exit tray 21 lies down on the sheet supply tray 20. In this state in which the second region 42 of the upper opening 40 of the sheet supply tray 20 is covered by the sheet exit tray 21, the expansion tray 96 of the sheet exit tray 21 is supported from its lower side by the expansion tray 72 of the sheet supply tray 20, with an sliding movement of the expansion tray 96 relative to the expansion tray 72 being restricted owing to engagements of the protrusions 74 with the respective recesses 93. Therefore, when the expansion tray 72 is slidingly moved relative to the tray main body 71 in the introducing direction 106 or drawing direction 108, the expansion tray 96 is slidingly moved in the same direction as the expansion tray 72. Consequently, the sheet exit tray 21 is expandable and contractible integrally with the sheet supply tray 20, with the second region 42 of the upper opening 40 of the sheet supply tray 20 being kept covered by the sheet exit tray 21.

An extension tray 13 is provided in a widthwise central portion of the rear end portion of the expansion tray 96 of the sheet exit tray 21 (see FIG. 4), such that the leading ends of the respective recording sheets discharged onto the sheet exit tray 21 are supported from their lower side by the extension tray 13. The extension tray 13 is slidingly movable relative to the expansion tray 96 in the introducing direction 106 and drawing direction 108, and can be accommodated in the expansion tray 96. FIGS. 2 and 3 show states in which the extension tray 13 is accommodated in the expansion tray 96.

Figure 10:
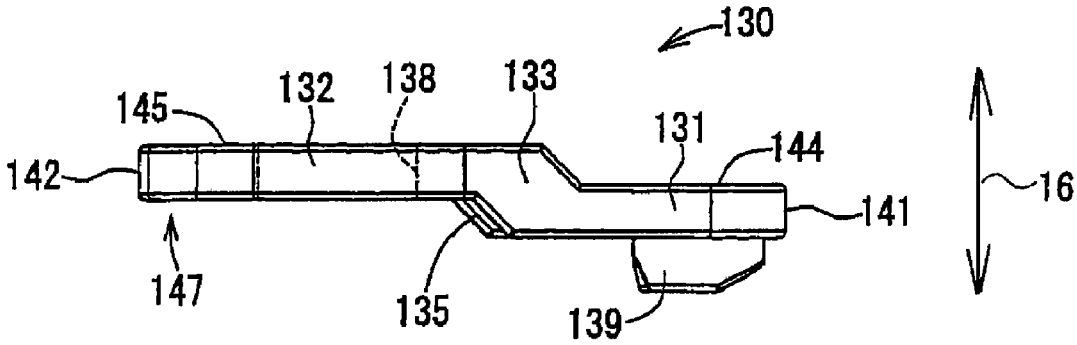
FIG. 10 is a plan view of the link 130.

There will be described a construction of each of the links 130. Each link 130 is provided to interconnect the tray main body 71 of the sheet supply tray 20 and the tray main body 95 of the sheet exit tray 21. As shown in FIGS. 9 and 10, each link 130 is constituted principally by the above-described first and second portions 131, 132 that are interconnected via the bent portion 133. The first portion 131 includes the first end portion 141 and extends to the bent portion 133. The second portion 132 includes the second end portion 142 and extends to the bent portion 133. The second portion 132 is offset from the first portion 131, inwardly in the width direction 16 of the sheet supply tray 20. As shown in FIG. 11, the first portion 131 is located between the side wall 81 and the inside wall 55, while the second portion 132 is located in substantially the same position as the inside wall 55 in the width direction 16 of the sheet supply tray 20. Thus, each link 130 is bent such that the second portion 132 is located inside the first portion 131 in the width direction 16 of the sheet supply tray 20. As shown in FIG. 9, the second portion 132 has a width (as measured in a direction perpendicular to drawing sheet of FIG. 10) slightly larger than that of the first portion 131, so that the second end portion 142 is placed in a height level slightly higher than a height level of the first end portion 141 in a state shown in FIG. 11, i.e., in a state in which the lower end 137 of the second portion 132 is in contact with the support surface 51 (see FIG. 7). It is noted that the bent portion 133 interconnecting the first and second portions 131, 132 is reinforced by ribs 135 (see FIG. 9).

Each of the links 130 has the above-described shaft 139 provided in the first end portion 141 (first portion 131), as shown in FIG. 9. The shaft 139 is received in the receiver hole 57 of the side wall 81, and has an outside diameter slightly smaller than an inside diameter of the receiver hole 57 so that the shaft 139 is rotatable relative to the receiver hole 57. The shaft 139 has such an axial length that an axially distal end of the shaft 139 does not protrude outwardly from the side wall 81 in rightward direction as seen in FIG. 7. The above-described predetermined distance between the inside wall 55 and the side wall 81 is larger than the thickness of the first portion 131, and is smaller than the sum of the thickness of the first portion 131 and the axial length of the shaft 139, so that the shaft 139 is prevented by cooperation of the inside wall 55 and the side wall 81, from being removed from the receiver hole 57. The shaft 139 has an axially distal end portion, which is partially cutout for facilitating the shaft 139 to be introduced into the receiver hole 57 so as to be attached to the support portion 121 (see FIG. 9).

Each link 130 has the above-described receiver hole 138 provided in the second end portion 142 (second portion 132). The receiver hole 138 is a through-hole formed through the second portion 132 in a thickness direction (i.e., vertical direction as seen in FIG. 10), and is located at substantially center of the second portion 132 (see FIG. 9). Each shaft 91 of the sheet exit tray 21 is introduced into the receiver hole 138 of the corresponding link 130, from the side of the second surface 145 (see FIG. 10) of the second portion 132 of the corresponding link 130. Each shaft 91 has the outside diameter that is slightly smaller than the inside diameter of the receiver hole 138 of the corresponding link 130, so as to be rotatably received in the receiver hole 138.

The shaft 139 provided in the first portion 131 of each link 130 is rotatably received in the corresponding receiver hole 57 of the sheet supply tray 20, while each shaft 91 of the sheet exit tray 21 is rotatably received in the receiver hole 138 provided in the second portion 132 of the corresponding link 130. Therefore, each link 130 is pivotably connected at the first end portion 141 to the sheet supply tray 20, and is pivotably connected at the second end portion 142 to the front end portion 97 of the sheet exit tray 21.

As described above, the sheet-supplying cassette 10 in its entirety is located inside the printer 100 in a state in which the cassette 10 is disposed in the printer 100. Therefore, the first end portion 141 of each link 130 is located within the printer 100.

Figure 12:
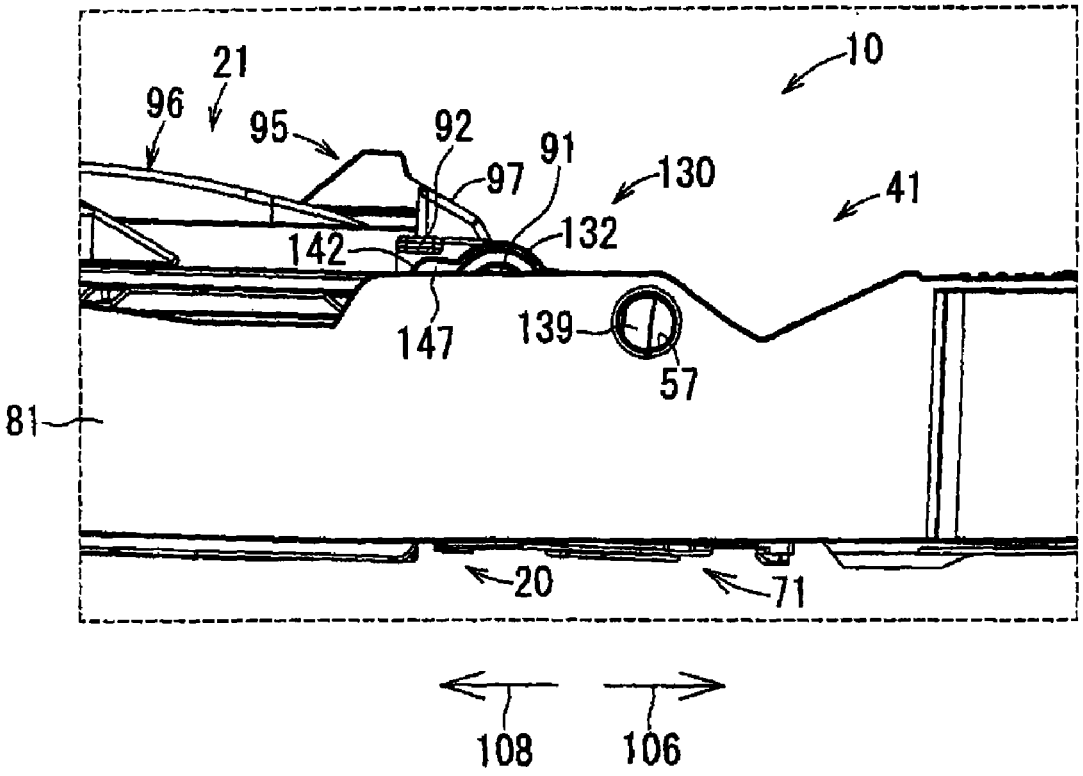
FIG. 12 is a side view showing, in enlargement, a part of the sheet-supplying cassette 10 in a state in which the sheet exit tray 21 covers a second region 42 of the sheet supply tray 20.

There will be described change of the posture of each link 130, which is caused by the pivot movement of the sheet exit tray 21 relative to the sheet supply tray 20. In a state, as shown in FIGS. 1 and 2, in which the sheet exit tray 21 lies down on the sheet supply tray 20, a weight of the sheet exit tray 21 acts on the second end portion 142 of each link 130 Therefore, in this state without an external force being applied to each link 130, the lower end 137 (see FIG. 9) of the second portion 132 is supported by the support surface 51 (see FIG. 7) of the corresponding support portion 121. Further, the second portion 132 is placed in a height level slightly higher than a height level of the first portion 131, as shown in FIG. 9. Thus, while being positioned in the first pivot position, each link 130 takes a first posture in which the second end portion 142 is placed in a height level slightly larger than a height level of the first end portion 141, and the first posture is maintained by the weight of the sheet exit tray 21 (FIGS. 11 and 12).

Where the second end portion 142 is higher than the first end portion 141, the second end portion 142 is upwardly displaced by an amount that is smaller than where the first end portion 141 is as high as the second end portion 142, upon pivot movement of each link 130 about the shaft 139. Where the second end portion 142 is lower than the first end portion 141, the corresponding shaft 91 is placed in a height level that is lower than where the second end portion 142 is as high as the first end portion 141, upon contact of the lower end 137 with the support surface 51 of the corresponding support portion 121. The reduction of the height level of the shafts 91 results in reduction of the number of recording sheets that can be accommodated in the sheet supply tray 20. Therefore, in the present embodiment, the first end portion 141 as well as the second end portion 142 is placed substantially in a first height level when the link 130 is positioned in the first pivot position, so that the first and second end portions 141, 142 have substantially the same height when the link 130 is positioned in the first pivot position. It is preferable that the second end portion 142 is slightly higher than the first end portion 141 although the second end portion 142 may be slightly lower than the first end portion 141. The term "first and second end portions 141, 142 having substantially the same height" may be interpreted to mean such a positional relationship between the first and second end portions 141, 142 that a lower end of the shaft 91 is positioned on a lower side of an upper end of the shaft 139 and an upper end of the shaft 91 is positioned on an upper side of a lower end of the shaft 138, as shown in FIG. 12 that is a side view of a part of the sheet-supplying cassette 10.

When a rear end portion (i.e., distal end portion) of the sheet exit tray 21 is raised by a user, the sheet exit tray 21 which has lain down on the sheet supply tray 20 is pivoted about the shafts 91 as a pivot axis in a forward direction that causes the rear end portion (i.e., distal end portion) of the sheet exit tray 21 to be moved away from the rear end 32 (see FIG. 1) of the sheet supply tray 20 toward the front end 29 (see FIG. 1) of the sheet supply tray 20. In a first stage of the pivot movement of the sheet exit tray 21 relative to the sheet supply tray 20 in the forward direction, each of the first protrusions 92 of the sheet exit tray 21 is moved from a position right above the distal end portion 147 of a corresponding one of the links 130 to a position right above the bent portion 133 of the corresponding link 130. In this first stage, each of the links 130 is held in the first pivot position so as to keep taking the substantially horizontal posture, since the weight of the sheet exit tray 21 acts on the second end portion 142 of each link 130 through a corresponding one of the shafts 91 (see FIG. 13). That is, in the first stage, the sheet exit tray 21 is pivoted about the second end portion 142 of each link 130, and each first protrusion 92 is brought into contact with the upper surface of the bent portion 133 of the corresponding link 130 (see FIG. 13). By the contact of each of the first protrusions 92 with the bent portion 133 of a corresponding one of the links 130, it is possible to stop the pivot movement of the sheet exit tray 21 relative to the links 130 (each of which is positioned in the first pivot position) in a direction away from the rear end 32 of the sheet supply tray 20 toward the front end 29 of the sheet supply tray 20. In this sense, each first protrusion 92 and the bent portion 133 of the corresponding link 130 cooperate with each other to constitute a cover-unit stopper mechanism configured to limit the pivot movement of the sheet exit tray 21 relative to the links 130 in the direction away from the rear end 32 of the sheet supply tray 20 toward the front end 29 of the sheet supply tray 20.

When the sheet exit tray 21 receives an external force forcing the tray 21 in a direction toward the front end 29 of the sheet supply tray 20 in the state in which each first protrusion 92 is in contact with the bent portion 133 of the corresponding link 130, the sheet exit tray 21 is pivoted together with the links 130 about the shafts 139 as a pivot axis in the direction toward the front end 29, with each first protrusion 92 being held in contact with the bent portion 133 of the corresponding link 130. Thus, the contact of each first protrusion 92 with the bent portion 133 of the corresponding link 130 initiates a second stage of the pivot movement in which the links 130 are pivoted or moved from the above-described first pivot position to a second pivot position in which each link 130 takes substantially vertical posture. During change of the posture of each link 130 in the second stage, a center of gravity of the sheet exit tray 21 is gradually displaced from a rear side of the shaft 139 of each link 130 (i.e., one of opposite sides of each shaft 139 that is closer to the rear end 32) onto a front side of the shaft 139 (i.e., the other of the opposite sides of each shaft 139 that is closer to the front end 29), the sheet exit tray 21 and the links 130 are easily pivoted about the first end portion 141 of each link 130. That is, in the second stage, the links 130 are pivoted together with the pivot movement of the sheet exit tray 21, about the shafts 139 in the direction away from the rear end 32 toward the front end 29. The second end portion 142 of each link 130 is placed in a second height level (see FIG. 14) that is higher than the above-described first height level (see FIGS. 12 and 23) when each link 130 is positioned in the second pivot position. It is noted that each link 130 is held in the first pivot position during the first stage, namely, until each first protrusion 92 is brought in contact with the bent portion 133 of the corresponding link 130.

Figure 14:
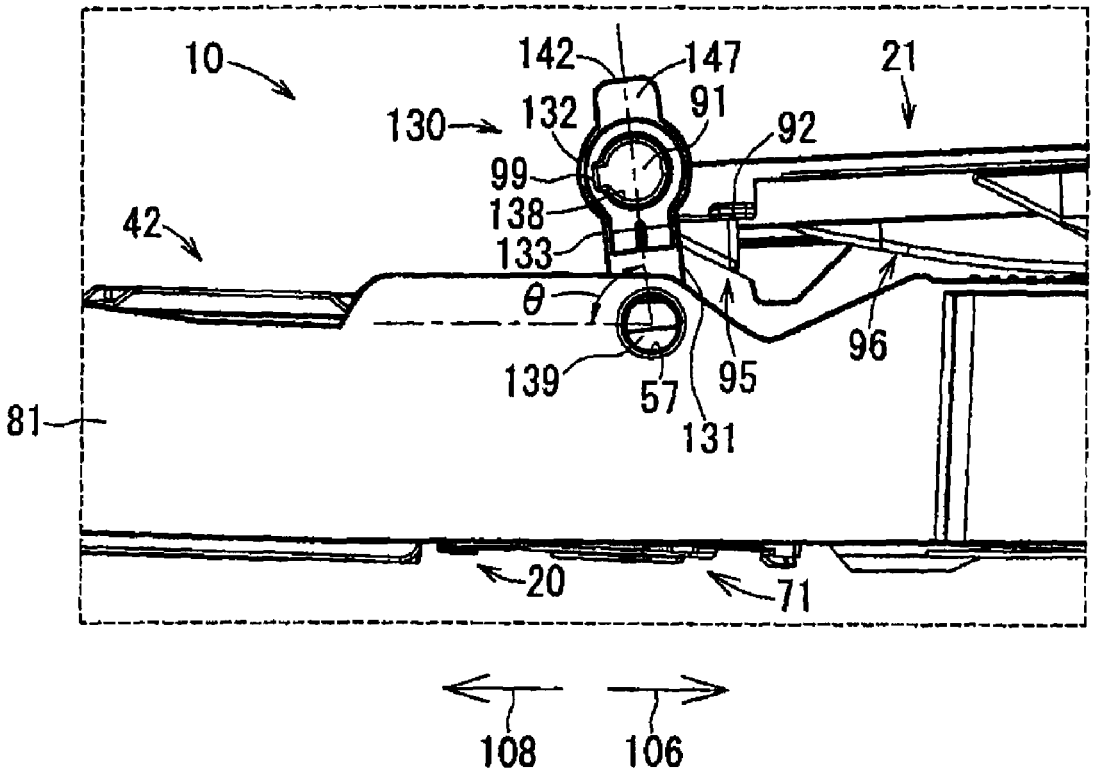
FIG. 14 is a side view showing, in enlargement, the part of the sheet-supplying cassette 10 in a state in which the sheet exit tray 21 covers a first region 41 of the sheet supply tray 20.
Figure 15:
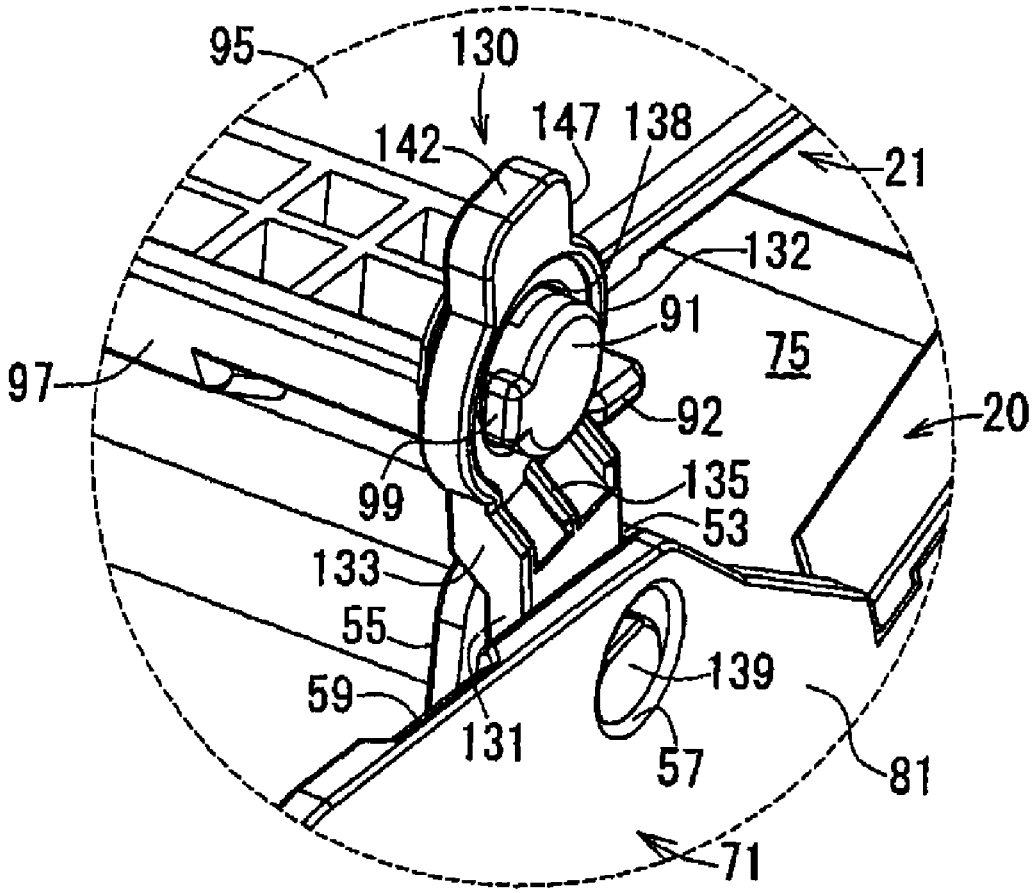
FIG. 15 is a view showing, in enlargement, a part XV of FIG. 3.

When the sheet exit tray 21 has been pivoted to a position for covering the first region 41 of the upper opening 40 of the sheet supply tray 20 (see FIGS. 3 and 14), the sheet exit tray 21 is brought into contact at its upper surface with the slant plate 22 so as to be supported from its lower side by the slant plate 22 whereby the pivot movement of the sheet exit tray 21 relative to the sheet supply tray 20 is stopped by the slant plate 22. Consequently, as shown in FIGS. 14 and 15, each link 130 is held in the second pivot position in which the second end portion 142 is positioned substantially right above the first end portion 141. That is, when each link 130 is positioned in the second pivot position, each link 130 takes a second posture in which the second end portion 142 of each link 130 is placed in a second height level that is higher than the first height level. In the present embodiment, the first and second end portions 141, 142 of each link 130 have substantially the same height when each link 130 is positioned in the first pivot position (see FIGS. 12 and 13), and each link 130 is slightly inclined with respect to a vertical direction when each link 130 is positioned in the second pivot position (see FIG. 14). Specifically, when each link 130 is positioned in the second pivot position, the second end portion 142 is positioned on one of opposite sides of the first end portion 141 which is closer to the rear end 32 of the sheet supply tray 20 than the other of the opposite sides. With each link 130 being positioned in the second pivot position, the second region 42 of the upper opening 41 of the sheet supply tray 20 is uncovered whereby the sheet supply tray 20 can be replenished with recording sheets.

When each link 130 has been moved from the first pivot position to the second pivot position, each first protrusion 92 is separated from the bent portion 133 of the corresponding link 130 (see FIG. 14). In this instance, the sheet exit tray 21 applies a force pulling each link 130 toward the front end 29 of the sheet supply tray 20. Each of the second protrusions 53 is provided on one of opposite sides of the first portion 131 of a corresponding one of the links 130, which is closer to the front end 29 of the sheet supply tray 20 than the other of the opposite sides of the first portion 131 of the corresponding link 130 (see FIG. 11). Each second protrusion 53 protrudes from the corresponding side wall 81 of the tray main body 71, inwardly in the width direction 16, i.e., a pivot-axis direction as a direction of the pivot axis about which the links 130 are pivotable relative to the sheet supply tray 20, such that the first end portion 141 of the corresponding link 130 is covered by the second protrusion 53. Therefore, an upper surface of the first portion 131 of each link 130 is brought into contact with the corresponding second protrusion 53 when the link 130 is inclined with respect to the vertical direction toward the rear end 32 of the sheet supply tray 20, i.e., leftward as seen in FIG. 14, so that pivot movement of the link 130 in a direction away from the rear end 32 toward the front end 29 is stopped. In other words, the links 130 are reliably prevented by the respective second protrusions 53, from being inclined toward the front end 29 of the sheet supply tray 20. In the present embodiment, each second protrusion 53 and the first portion 131 of the corresponding link 130 cooperate with each other to constitute a link stopper mechanism to limit the pivot movement of the link 130 relative to the sheet supply tray 20 in the direction away from the rear end 32 toward the front end 29. Further, in the present embodiment, positions and dimensions of each link 130, the corresponding receiver hole 57 and the corresponding second protrusion 53 are determined such that a line extending from an axis of the shaft 139 of the link 130 toward the rear end 32 and a line extending from the axis of the shaft 139 in a longitudinal direction of the link 130 cooperate with each other to define an angle θ that is larger than 70° and smaller than 90° (70°<θ<90°), as shown in FIG. 14. If the angle θ is not smaller than 90°, a center of gravity of the sheet exit tray 21 is displaced too much upon pivot movement of each link 130 from the second pivot position to the first pivot position, thereby causing a problem that the link 130 cannot be smoothly pivoted. If the angle θ is not larger than 70°, each shaft 91 is upwardly displaced by only a small amount upon pivot movement of the corresponding link 130 from the first pivot position to the second pivot position. In the present embodiment, the angle θ is about 80° for enabling each shaft 91 to be upwardly displaced by a sufficiently large amount upon pivot movement of the corresponding link 130 from the first pivot position to the second pivot position, and for enabling the posture of each link 130 to be smoothly changed upon pivot movement of the link 130 from the second pivot position to the first pivot position.

When the rear end portion (i.e., distal end portion) of the sheet exit tray 21 (covering the first region 41 as shown in FIG. 3) is raised toward the rear end 32 of the sheet supply tray 20, the weight of the sheet exit tray 21 is applied via the shaft 91 to the second end portions 142 of the respective links 130, whereby the links 130 are pivoted toward the rear end 32 of the sheet supply tray 20 until the first protrusions 92 of the sheet exit tray 21 are brought into contact with the upper surfaces of the bent portions 133 of the respective links 130. Since the center of gravity of the sheet exit tray 21 lies on one of opposite sides of the axis of the shafts 139 that is closer to the front end 29 of the sheet supply tray 20, the contacts of the first protrusions 92 with the bent portions 133 are maintained. Therefore, the sheet exit tray 21 is pivoted integrally with the links 130 about the axis of the shafts 139 as the pivot axis toward the rear end 32 of the sheet supply tray 21, and the center of gravity of the sheet exit tray 21 is gradually displaced toward the rear end 32 (i.e., leftward as seen in FIG. 14), so that a load acting on each of the receivers holes 138 of the respective links 130 is gradually increased whereby the second end portions 142 of the respective links 130 are moved toward the rear end 32. Each link 130 is thus moved from the second pivot position (see FIGS. 14 and 15) to the first pivot position (see FIG. 13) whereby the posture of the link 130 is changed. Each link 130 is held in the first pivot position by contact of the lower end 137 of the second portion 132 of the link 130 with the with the support surface 51 of the corresponding support portion 121.

When the sheet exit tray 21 further receives an external force forcing the tray 21 toward the rear end 32 after each link 130 has been moved to the second pivot position to the first pivot position, the first protrusions 92 of the sheet exit tray 21 are separated from the bent portions 133 of the respective links 130, and the sheet exit tray 21 is pivoted toward the rear end 32 of the sheet supply tray 20 about the axis of the shafts 91 as the pivot axis. When the side walls 98 of the sheet exit tray 21 are in contact with the upper surfaces of the respective side end guides 111, the sheet exit tray 21 is supported from its lower side by the sheet supply tray 20, and covers the second region 42 of the upper opening 40 of the sheet supply tray 20 (see FIGS. 1 and 12). Since the second region 42 of the upper opening 40 is thus covered, it is possible to prevent dust or trash from entering into the sheet supply tray 20, and also to prevent recording sheets (that have been subjected to recording operations) from entering into the sheet supply tray 20 for avoiding jamming of the recording sheet.

As described above, when the sheet exit tray 21 covering the second region 42 of the upper opening 40 of the sheet supply tray 20 is opened, namely, when the sheet exit tray 21 is pivoted relative to the sheet supply tray 20 in the forward direction that causes the rear end portion (i.e., distal end portion) of the sheet exit tray 21 to be moved away from the rear end 32 of the sheet supply tray 20 toward the front end 42 of the sheet supply tray 20, each link 130 is moved from the first pivot position (see FIG. 12) to the second pivot position (see FIG. 14) whereby the posture of each link 130 is changed. By the pivot movement of each link 130 from the first pivot position to the second pivot position, the front end portion 97 (i.e., proximal end portion) of the sheet exit tray 21 is displaced upwardly together with the second end portions 142 of the respective links 130 (at which the links 130 are pivotably connected to the front end portion 97 of the sheet exit tray 21). The upward displacement of the front end portion 97 of the sheet exit tray 21 leads to an upward expansion of a space available for introduction of the recording sheets into the sheet supply tray 20 via the second region 42 of the upper opening 40 of the sheet supply tray 20. Therefore, without having to increase a vertical dimension of the sheet-supplying cassette 10, it is possible to obtain a sufficient amount of space defined on a lower side of the front end portion 97 of the sheet exit tray 21, which is required for introducing the recording sheets into the sheet supply tray 20 via the second region 42 of the upper opening 40.

Further, in the present embodiment, the first end portions 141 of the respective links 130 are located within the printer 100 when the sheet-supplying cassette 10 is disposed within the printer 100. Since the vertical dimension of the sheet-supplying cassette 10 does not necessarily have to be increased, as described above, the printer 100 as whole can have a small vertical dimension while obtaining the above-described sufficient amount of space that is required for introducing the recording sheets into the sheet supply tray 20. The printer 100 is likely to have a large size (e.g., large vertical dimension) due to the lower tray 103 that is disposed on a lower side of the sheet supply tray 20. The sheet-supplying cassette 10 as the sheet tray assembly according to the present invention having the above-described advantages is effective, especially, where the cassette 10 is disposed in such a printer having a large size or vertical dimension. It is noted that the first end portions 141 of the respective links 130 may be located outside an image recording apparatus when the sheet-supplying cassette 10 is disposed within the image recording apparatus.

Further, in the present embodiment, each first protrusion 92 of the sheet exit tray 21 and the bent portion 133 of the corresponding link 130 cooperate with each other to constitute a link pivot-movement initiator configured to initiate the pivot movement of the link 130 relative to the sheet supply tray 20 from the first pivot position to the second pivot position, when the sheet exit tray 21 becomes inclined with respect to the link 130 by a given degree during the pivot movement of the sheet exit tray 21 relative to the sheet supply tray 20 in the forward direction. When each link 130 is positioned in the second pivot position, the link 130 is inclined with respect to the vertical direction toward the rear end 32 of the sheet supply tray 20 (i.e., leftward as seen in FIG. 14). This inclined posture of each link 130 is reliably maintained by the corresponding second protrusion 53 (see FIG. 15). The posture of each link 130, which is inclined toward the rear end 32, facilitates the link 130 to be smoothly pivoted from the second pivot position to the first pivot position.

Further, in the present embodiment, each link 130 has a bent shape such that the second end portion 142 is located inside the first end portion 141 in the width direction 16, i.e., the pivot-axis direction. This arrangement is effective to provide a space available for provisions of the protrusions 99 which are provided outside of the second portions 132 of the respective links 130 for preventing the shafts 91 from being removed from the respective receiver holes 138 of the respective links 130, without increasing the width of the sheet supply tray 20.

In the present embodiment, the sheet-supplying cassette 10 as the sheet tray assembly according to the invention is disposed in the inkjet printer 100 as the image recording apparatus. However, the image recording apparatus in which the sheet tray assembly is to be disposed may be a laser printer or any other image recording apparatus.

The posture of each link 130 upon positioning of the link 130 in the first and second pivot position is not limited to the detail of the above-described embodiment, but may be otherwise embodied. For example, when each link 130 is positioned in the first pivot position, the second end portion 142 may be positioned higher than the first end portion 141. When each link 130 is positioned in the second pivot position, the second end portion 142 may be positioned right above the first end portion 141.

While the first protrusions 92 of the cover-unit stopper mechanism are provided in the sheet exit tray 21 in the present embodiment, the first protrusions may be provided in the respective links 130 such that the first protrusions can be in contact with the sheet exit tray 21. Further, while the second protrusions 53 of the link stopper mechanism are provided in the sheet supply tray 20 in the present embodiment, the second protrusions may be provided in the respective links 130 such that the second protrusions can be in contact with the sheet supply tray 20.

What is claimed is:

1. A sheet tray assembly that is to be detachably disposed in an image recording apparatus, said tray assembly comprising:

(a) a tray unit configured to accommodate sheets, and having an upper opening for allowing the sheets to be introduced into said tray unit via said upper opening, said upper opening being sectioned into first and second regions such that a front end of said tray unit is closer to said first region than to said second region while a rear end of said tray unit is closer to said second region than to said first region;

(b) a cover unit configured to cover said second region of said upper opening at least when said sheet tray assembly is disposed in the image recording apparatus; and (c) a link interconnecting said tray unit and said cover unit, and having (c-1) a first end portion at which said link is pivotably connected to said tray unit and (c-2) a second end portion at which said link is pivotably connected to a proximal end portion of said cover unit, wherein said link is movable between first and second pivot positions relative to said tray unit as a result of pivot movement of said link relative to said tray unit, whereby a posture of said link relative to said tray unit is changeable by the pivot movement, such that said second end portion of said link is placed in a first height level when said link is positioned in said first pivot position, and is placed in a second height level that is higher than said first height level when said link is positioned in said second pivot position.

2. The sheet tray assembly according to claim 1, wherein said cover unit is pivotable relative to said tray unit, so as to cover said second region of said upper opening without covering said first region of said upper opening at least when said sheet tray assembly is disposed in the image recording apparatus, and so as to uncover said second region at least when the sheets are to be introduced into said tray unit via said second region of said upper opening, and wherein said second region can be covered by said cover unit when said link is positioned in said first pivot position, and is not covered by said cover unit when said link is positioned in said second pivot position.

3. The sheet tray assembly according to claim 1, wherein said first end portion of said link is located within the image recording apparatus when said sheet tray assembly is disposed in the image recording apparatus.

4. The sheet tray assembly according to claim 1, further comprising a cover-unit stopper mechanism configured to limit pivot movement of said cover unit relative to said link in a direction away from said rear end of said tray unit toward said front end of said tray unit.

5. The sheet tray assembly according to claim 4, wherein said cover-unit stopper mechanism is configured to stop the pivot movement of said cover unit relative to said link in the direction away from said rear end of said tray unit toward said front end of said tray unit, in a state in which said cover unit is inclined with respect to a vertical direction toward said front end of said tray unit while said link is positioned in said first pivot position.

6. The sheet tray assembly according to claim 4, wherein said cover-unit stopper mechanism includes a protrusion which is provided on said cover unit and which is to be brought into contact with said link.

7. The sheet tray assembly according to claim 1, wherein said first end portion of said link is placed substantially in said first height level when said link is positioned in said first pivot position, so that said first and second end portions of said link have substantially the same height when said link is positioned in said first pivot position.

8. The sheet tray assembly according to claim 1, further comprising a link stopper mechanism configured to limit pivot movement of said link relative to said tray unit in a direction away from said rear end of said tray unit toward said front end of said tray unit, wherein said link stopper mechanism is configured to stop the pivot movement of said link relative to said tray unit, in a state in which said link is inclined with respect to a vertical direction toward said rear end of said tray unit.

9. The sheet tray assembly according to claim 8, wherein said link stopper mechanism includes a protrusion which is provided on said tray unit and which is to be brought into contact with said link.

10. The sheet tray assembly according to claim 1, wherein said cover unit is disposed inside an end wall of said tray unit in a pivot-axis direction as a direction of a pivot axis about which said link is pivotable relative to said tray unit, with said link being interposed between said cover unit and said end wall of said tray unit in the pivot-axis direction, wherein said link has (c-3) a first shaft provided in said first end portion thereof and (c-4) a first hole provided in said second end portion thereof, wherein said tray unit has a second hole provided in said end wall thereof such that said first shaft is rotatably received in said second hole, and wherein said cover unit has, as said proximal end portion thereof a second shaft that is rotatably received in said first hole.

11. The sheet tray assembly according to claim 10, wherein said second shaft received in said first hole has a distal end portion that projects outwardly from said first hole in the pivot-axis direction, wherein said distal end portion of said second shaft has a protrusion which protrudes outwardly in a radial direction of said second shaft and which has a radially outer end located outside said first hole in the radial direction, and wherein said link has a bent shape such that said second end portion is located inside said first end portion in the pivot-axis direction.

12. The sheet tray assembly according to claim 1, wherein said cover unit is configured to receive the sheets discharged from a sheet path along which the sheets are to be conveyed after being supplied from said tray unit.

13. The sheet tray assembly according to claim 1, wherein said link is moved from said first pivot position to said second pivot position, during pivot movement of said cover unit relative to said tray unit in a forward direction that causes a distal end portion of said cover unit to be moved away from said rear end of said tray unit toward said front end of said tray unit, with an external force being applied to said cover unit, and wherein said cover unit is pivoted about said second end portion of said link in a first stage of the pivot movement of said cover unit relative to said tray unit in which said link is positioned in said first pivot position, and is pivoted about said first end portion of said link in a second stage of the pivot movement of said cover unit relative to said tray unit in which said link is moved from said first pivot position to said second pivot position.

14. The sheet tray assembly according to claim 1, wherein said link is moved from said first pivot position to said second pivot position, during pivot movement of said cover unit relative to said tray unit in a forward direction that causes a distal end portion of said cover unit to be moved away from said rear end of said tray unit toward said front end of said tray unit, with an external force being applied to said cover unit, said sheet tray assembly further comprising a link pivot-movement initiator configured to initiate the pivot movement of said link relative to said tray unit from said first pivot position toward said second pivot position, when said cover unit becomes inclined with respect to said link by a given degree during the pivot movement of said cover unit relative to said tray unit in the forward direction.

15. The sheet tray assembly according to claim 14, wherein said link pivot-movement initiator includes a cover-unit stopper mechanism configured to stop pivot movement of said cover unit relative to said link in a direction away from said rear end of said tray unit toward said front end of said tray unit, when said cover unit becomes inclined with respect to said link by the given degree.

16. The sheet tray assembly according to claim 1, wherein said cover unit is pivotable relative to said tray unit, so as to selectively cover and uncover said second region of said upper opening such that said first region of said upper opening is uncovered by said cover unit when said second region of said upper opening is covered by said cover unit, and wherein said first and second regions of said upper opening are located on respective opposite sides of a pivot axis about which said link is provided relative to said tray unit.

17. The sheet tray assembly according to claim 1, wherein said cover unit is disposed inside an end wall of said tray unit in a pivot-axis direction as a direction of a pivot axis about which said link is pivotable relative to said tray unit, with said link being interposed between said cover unit and said end wall of said tray unit in the pivot-axis direction.

* * * * *